US008848952B2

(12) United States Patent
Iwata

(10) Patent No.: US 8,848,952 B2
(45) Date of Patent: Sep. 30, 2014

(54) AUDIO REPRODUCTION APPARATUS

(75) Inventor: Kazuya Iwata, Osaka (JP)

(73) Assignee: Panasonic Corporation, Osaka (JP)

( * ) Notice: Subject to any disclaimer, the term of this patent is extended or adjusted under 35 U.S.C. 154(b) by 547 days.

(21) Appl. No.: 13/319,141

(22) PCT Filed: Apr. 30, 2010

(86) PCT No.: PCT/JP2010/003085
§ 371 (c)(1),
(2), (4) Date: Nov. 7, 2011

(87) PCT Pub. No.: WO2010/131431
PCT Pub. Date: Nov. 18, 2010

(65) Prior Publication Data

US 2012/0051565 A1 Mar. 1, 2012

(30) Foreign Application Priority Data

May 11, 2009 (JP) ..... 2009-114290

(51) Int. Cl.
*H04R 5/02* (2006.01)
*H04S 3/00* (2006.01)

(52) U.S. Cl.
CPC ..... *H04S 3/002* (2013.01); *H04S 2400/01* (2013.01); *H04S 2400/03* (2013.01); *H04S 2420/05* (2013.01); *H04S 2420/01* (2013.01)
USPC ..... 381/307

(58) Field of Classification Search
CPC ..... H04S 2400/01; H04S 2400/03; H04S 2420/05; H04S 2420/01
USPC ..... 381/307
See application file for complete search history.

(56) References Cited

U.S. PATENT DOCUMENTS 5,838,800 A 11/1998 Lowe et al.
5,970,152 A 10/1999 Klayman
(Continued)

FOREIGN PATENT DOCUMENTS

JP 9-322300 12/1997
JP 2001-501784 2/2001
(Continued)

OTHER PUBLICATIONS

International Search Report issued Jun. 1, 2010 in International (PCT) Application No. PCT/JP2010/003085.

*Primary Examiner* — Duc Nguyen
*Assistant Examiner* — Kile Blair
(74) *Attorney, Agent, or Firm* — Wenderoth, Lind & Ponack, L.L.P.

(57) ABSTRACT

An audio reproduction apparatus includes: a delay equalizer (301), a delay equalizer (303), a level adjuster (314), and a level adjuster (317). The delay equalizer (301) equalizes an FL signal using an equalizer characteristic EQ9 that converts a characteristic of an audio signal perceived as being reproduced at a position of an FL speaker (104) with respect to a viewing position to be perceived as being reproduced at a position of a virtual speaker (201) with respect to the viewing position. The delay equalizer (303) equalizes the FL signal using an equalizer characteristic (EQ12) that converts a characteristic of an audio signal perceived as being reproduced at a position of an SL speaker (106) with respect to a viewing position to be perceived as being reproduced at a position of the virtual speaker (201) with respect to the viewing position. The level adjuster (314) performs level adjustment, using a first coefficient K9, on an output signal of the delay equalizer (301). The level adjuster (317) performs level adjustment, using a second coefficient K12, on an output signal of the delay equalizer (303).

19 Claims, 11 Drawing Sheets

(56) References Cited

U.S. PATENT DOCUMENTS

| | | | | |
|---|---|---|---|---|
| 7,218,740 | B1 | 5/2007 | Kowaki | |
| 7,391,869 | B2 | 6/2008 | Eid et al. | |
| 7,443,987 | B2 | 10/2008 | Griesinger | |
| 2003/0206639 | A1 | 11/2003 | Griesinger | |
| 2004/0086130 | A1 | 5/2004 | Eid et al. | |
| 2004/0125967 | A1 | 7/2004 | Eid et al. | |
| 2011/0249819 | A1* | 10/2011 | Davis | 381/17 |

FOREIGN PATENT DOCUMENTS

| | | |
|---|---|---|
| JP | 2005-525022 | 8/2005 |
| JP | 2005-341208 | 12/2005 |
| JP | 2009-044261 | 2/2009 |
| JP | 2009-100144 | 5/2009 |
| WO | 97/41711 | 11/1997 |
| WO | 03/094396 | 11/2003 |

* cited by examiner

AUDIO REPRODUCTION APPARATUS

TECHNICAL FIELD

The present invention relates to an audio reproduction apparatus for reproducing a diffuse sound field with high realistic sensation, even with a 5.1-channel speaker system which includes a pair of surround channel speakers.

BACKGROUND ART

In recent years, the advent of media which provide high vision images and multi-channel audio, such as digital broadcasting and blu-ray discs, has allowed home users to easily enjoy content with a high-quality sound and image. Furthermore, along with the widespread use of thin large-screen televisions, the home theater system for home movie entertainment has come under the spotlight. An audio reproduction system is especially in demand, which can provide a reproduced sound with high audio quality and high realistic sensation commensurate with the large-screen. Blu-ray discs, in particular, have a format with which 13.1-channel audio signals can be recorded (existing content is for 7.1 channels at a maximum), a sound field with high realistic sensation is expected to be provided by reproduced sounds of the blu-ray discs. Meanwhile, with the increase of the number of the channels, the number of speakers necessary for the reproduction increases as well as the realistic sensation, resulting in a step in the opposite direction to the easiness of the home theater system.

In view of the above, a multi-channel sound field reproduction apparatus has been conventionally proposed which has a multi-channel sound field reproduction system for reproducing 7.1-channel signals using 5.1-channel speakers.

FIG. 1 is a diagram illustrating an example of a conventional multi-channel sound field reproduction apparatus (see, Patent Reference 1).

The following describes an operation performed by the conventional multi-channel sound field reproduction apparatus with reference to FIG. 1.

FIG. 1 shows an example of a multi-channel sound field reproduction system for reproducing 7.1-channel signals using 5.1-channel speakers. The multi-channel sound field reproduction system includes: an arithmetic unit F1*a* which generates a sum signal and a difference signal of back surround signals BL and BR; a finite impulse response (FIR) filter F1*b* which processes the sum signal; a FIR filter F1*c* which processes the difference signal; an arithmetic unit F1*d* which generates a sum signal and a difference signal of signals processed by the FIR filters F1*b* and F1*c*; and an adder a and an adder b which add the sum signal and the difference signal processed by the arithmetic unit F1*d* to a side surround signal SL and a side surround signal SR, respectively.

Speaker placement according to the ITU-RBS. 775-1 recommendation, as shown in FIG. 2, is suggested for audio reproduction with the 5.1-channel system. Back surround channels which are added in the 7.1-channel system are placed further backward than SL and SR, at approximately 150 degrees. With the example of the conventional technique, the audio signals BL and BR of the back surround channels are processed and added to the surround channel signals SL and SR, thereby producing an effect of the 7.1-channel speakers with a 5.1-channel speaker configuration in which speakers for back surround channels are not provided.

First, 5.1-channel surround speakers SR and SL are placed not in the direction of 120 degrees; that is, diagonally backward right and diagonally backward left with respect to a viewer, but in the direction of 90 degrees; that is, in the direction immediately right and in the direction immediately left with respect to the viewer.

In processing the back surround signals, a pair of back surround signals BL and BR are calculated in the arithmetic unit F1*a* to generate a sum and a difference components. Then the sum signal is processed by the FIR filter F1*b*, the difference signal is processed by the FIR filter F1*c*, and the arithmetic unit F1*d* generates a sum and a difference signals. Transmission characteristics P and N of the FIR filters F1*b* and F1*c* are represented by the expressions below.

$$P=(F+K)/(S+A)$$

$$N=(F-K)/(S-A)$$

Here, S indicates the transmission characteristic from a real speaker to the ear of the viewer on the same side as the real speaker, A indicates the transmission characteristic to the opposite ear of the viewer, F indicates the transmission characteristic from a position at which a sound image is to be localized to the ear of the viewer on the same side as the position, K indicates the transmission characteristic from the position at which a sound image is to be localized to the opposite ear of the viewer, and a head-related transfer function of the viewer is used.

As described above, a pair of back surround signals BL and BR are subject to sound image localization processing, added to audio signals of the SL channel and the SR channel, respectively, by the adder a and adder b, supplied, as output signals of the SL channel and the SR channel, to left and right side surround speakers SL and SR to be reproduced. It is possible, as described above, to realize sound image localization and realistic sensation of 7.1 channels easily at home with the 5.1-channel speaker configuration, by performing sound image localization processing on back surround signals to be added to the side surround speakers and reproduced.

CITATION LIST

Patent Literature

[PTL 1] Japanese Unexamined Patent Application Publication No. 2005-341208

SUMMARY OF INVENTION

Technical Problem

However, the conventional techniques have a problem in that the effect is heavily affected by the positional relationship between the surround speakers and a viewer because the surround speakers are placed in the directions immediately left and right with respect to the viewer so that head-related transfer characteristic for surround back is accurately reproduced. More specifically, there is a problem that, since crosstalk cancellation operation is performed in the conventional techniques, the viewer has to be at the center position surrounded by speakers for viewing as shown in FIG. 2, and sound image localization of back surround signals cannot be implemented at a desired position of virtual speakers due to only a slight difference in the viewing position.

In addition, there is a problem that, since the speakers are placed in the directions immediately left and right with respect to the viewer, a sound field created by original surround channels cannot be accurately reproduced.

Furthermore, the conventional examples allow only the reproduction of surround back signals, and cannot reproduce a sense of sound field between a front speaker and a surround speaker. Thus, there is a problem that a sound field cannot be reproduced which allows feeling a natural surround which is seamless in all of the directions.

The present invention solves the problems of the conventional techniques, and an object of the present invention is to provide an audio reproduction apparatus which allows sound field reproduction without affected by the positional relationship between the speakers and a viewer and without losing a surround feeling of content and which allows feeling a natural surround which is seamless in all of the directions without being aware of the fact that the sound is reproduced from the speakers.

Solution to Problem

In order to solve the above problem, an audio reproduction apparatus according to an aspect of the present invention is an audio reproduction apparatus which performs signal processing on an audio signal so that, when the audio signal is reproduced by a first speaker and a second speaker which actually exist, a viewer perceives the audio signal as being reproduced by a virtual speaker, the virtual speaker being assumed to be placed between the first speaker and the second speaker with respect to a predetermined viewing position, and which includes: a first signal processing unit configured to equalize a first audio signal using a first equalizer characteristic that converts a characteristic of an audio signal perceived as being reproduced at a position of the first speaker with respect to the viewing position to be perceived as being reproduced at a position of the virtual speaker with respect to the viewing position; a second signal processing unit configured to equalize the first audio signal using a second equalizer characteristic that converts a characteristic of an audio signal perceived as being reproduced at a position of the second speaker with respect to the viewing position to be perceived as being reproduced at the position of the virtual speaker with respect to the viewing position; a first level adjuster which performs level adjustment, using a first coefficient, on an output signal of the first signal processing unit; a second level adjuster which performs level adjustment, using a second coefficient, on an output signal of the second signal processing unit; a first adder which adds, and outputs to the first speaker, an output signal of the first level adjuster and the first audio signal; and a second adder which adds, and outputs to the second speaker, an output signal of the second level adjuster and a second audio signal to be reproduced by the second speaker.

In addition, the first equalizer characteristic may be a transfer characteristic obtained by dividing a transfer characteristic from the position of the virtual speaker to the viewing position by a transfer characteristic from the first speaker to the viewing position, the second equalizer characteristic may be a transfer characteristic obtained by dividing the transfer characteristic from the position of the virtual speaker to the viewing position by a transfer characteristic from the second speaker to the viewing position, the first signal processing unit may delay, and output to the first level adjuster, the first audio signal using a first delay characteristic after equalizing the first audio signal using the first equalizer characteristic, and the second signal processing unit may be delay, and output to the second level adjuster, the first audio signal using a second delay characteristic after equalizing the first audio signal using the second equalizer characteristic.

In addition, the first equalizer characteristic and the second equalizer characteristic may be a frequency characteristic of an amplitude component of the first transfer characteristic and a frequency characteristic of an amplitude component of the second transfer characteristic, respectively.

In addition, each of the first equalizer characteristic and the second equalizer characteristic may by a characteristic obtained by extracting characteristic portions of a peak and a dip of the frequency characteristic of the amplitude component in a band of 1 kHz or higher.

In addition, a period of delay time of each of the first delay characteristic and the second delay characteristic may be equal to or shorter than a period of time during which the Haas effect is produced.

In addition, when K1 denotes the first coefficient, K2 denotes the second coefficient, θ1 denotes an angle between the first speaker and the virtual speaker with respect to the viewing position, and θ2 denotes an angle between the virtual speaker and the second speaker with respect to the viewing position, Expression 1

$$\frac{K1}{K2} = \frac{|\sin\theta 2|}{|\sin\theta 1|}$$

may be satisfied.

In addition, the audio reproduction apparatus may further includes: a third signal processing unit configured to equalize the second audio signal using a third equalizer characteristic and delay the equalized second audio signal using a third delay characteristic; a third level adjuster which performs level adjustment, using a third coefficient, on an output signal of the third signal processing unit; a fourth signal processing unit configured to equalize the second audio signal using a fourth equalizer characteristic and delay the equalized second audio signal using a fourth delay characteristic; and a fourth level adjuster which performs level adjustment, using a fourth coefficient, on an output signal of the fourth signal processing unit, wherein the first adder may further add an output signal of the third level adjuster, the second adder may further add an output signal of the fourth level adjuster, the third equalizer characteristic, when the virtual speaker is a first virtual speaker and a second virtual speaker is a virtual speaker assumed to be placed between the first virtual speaker and the second speaker with respect to the viewing position, may a third transfer characteristic obtained by dividing a transfer characteristic from the second virtual speaker to the viewing position by a transfer characteristic from the first speaker to the viewing position, and the fourth equalizer characteristic may a fourth transfer characteristic obtained by dividing a transfer characteristic from the second virtual speaker to the viewing position by a transfer characteristic from the second speaker to the viewing position.

In addition, the transfer characteristic may be a head-related transfer characteristic.

In addition, each of the first to fourth equalizer characteristics may be calculated, as the transfer characteristic, by using a head-related transfer characteristic to an ear on a side where the first virtual speaker or the second virtual speaker is placed.

In addition, when K3 denotes the third coefficient, K4 denotes the fourth coefficient, θ3 denotes an angle between the first speaker and the second virtual speaker with respect to the viewing position, and θ4 denotes an angle between the second virtual speaker and the second speaker with respect to the viewing position, Expression 2

$$\frac{K3}{K4} = \frac{|\sin\theta 4|}{|\sin\theta 3|}$$

may be satisfied.

In addition, the first audio signal, the second audio signal, the first speaker, and the second speaker may correspond to a front L channel signal, a surround L channel signal, a front L channel speaker, and a surround L channel speaker, respectively, and the first audio signal, the second audio signal, the first speaker, and the second speaker also may correspond to a front R channel signal, a surround R channel signal, a front R channel speaker, and a surround R channel speaker, respectively.

In addition, when an angle of a direction toward a front of the viewing position is 0 degree, the first speaker and the second speaker may be placed at 30 degrees and the 120 degrees, respectively, in a counterclockwise direction, or at 30 degrees and the 120 degrees, respectively, in a clockwise direction, and the first virtual speaker and the second virtual speaker may be placed at 60 degrees and the 90 degrees, respectively, in the counterclockwise direction, or at 60 degrees and the 90 degrees, respectively, in the clockwise direction.

In addition, the audio reproduction apparatus may further includes: a fifth signal processing unit configured to perform signal processing on a third audio signal by equalizing the third audio signal using a fifth equalizer characteristic and delaying the equalized third audio signal using a fifth delay characteristic, and to cause the third audio signal on which the signal processing is performed to be reproduced by a third speaker, so that the third audio signal is localized at a position of a third virtual speaker assumed to be placed between the third speaker and a fourth speaker with respect to the viewing position; a sixth signal processing unit configured to perform signal processing on the third audio signal by equalizing the third audio signal using a sixth equalizer characteristic and delaying the equalized third audio signal using a sixth delay characteristic, and to cause the third audio signal on which the signal processing is performed to be reproduced by the fourth speaker, so that the third audio signal is localized at a position of the third virtual speaker;

a seventh signal processing unit configured to perform signal processing on a fourth audio signal by equalizing the fourth audio signal using a seventh equalizer characteristic and delaying the equalized fourth audio signal using a seventh delay characteristic, and to cause the fourth audio signal on which the signal processing is performed to be reproduced by the third speaker, so that the fourth audio signal is localized at a position of a fourth virtual speaker assumed to be placed between the third virtual speaker and the fourth speaker with respect to the viewing position; and an eighth signal processing unit configured to perform signal processing on the fourth audio signal by equalizing the fourth audio signal using an eighth equalizer characteristic and delaying the equalized fourth audio signal using an eighth delay characteristic, and to cause the fourth audio signal on which the signal processing is performed to be reproduced by the fourth speaker, so that the fourth audio signal is localized at a position of the fourth virtual speaker, wherein the third speaker may be the SL speaker, and the fourth speaker may be the SR speaker, the second adder that outputs a signal to the SL speaker further may add an output signal of the fifth signal processing unit and an output signal of the seventh signal processing unit, and the second adder that outputs a signal to the SR speaker may further add an output signal of the sixth signal processing unit and an output signal of the eighth signal processing unit.

Advantageous Effects of Invention

With the configuration described above, an audio reproduction apparatus according to the present invention can implement, with a simple configuration, sound field reproduction which covers a huge area without losing a surround sensation of content and which allows feeling a natural surround which is seamless in all of the directions without being aware of the fact that the sound is reproduced from the speakers, with a 5.1-channel speaker configuration.

DESCRIPTION OF EMBODIMENTS

Embodiment 1

The following describes in detail an operation and each of the elements of an audio reproduction apparatus according to Embodiment 1 of the present invention.

Figure 3:
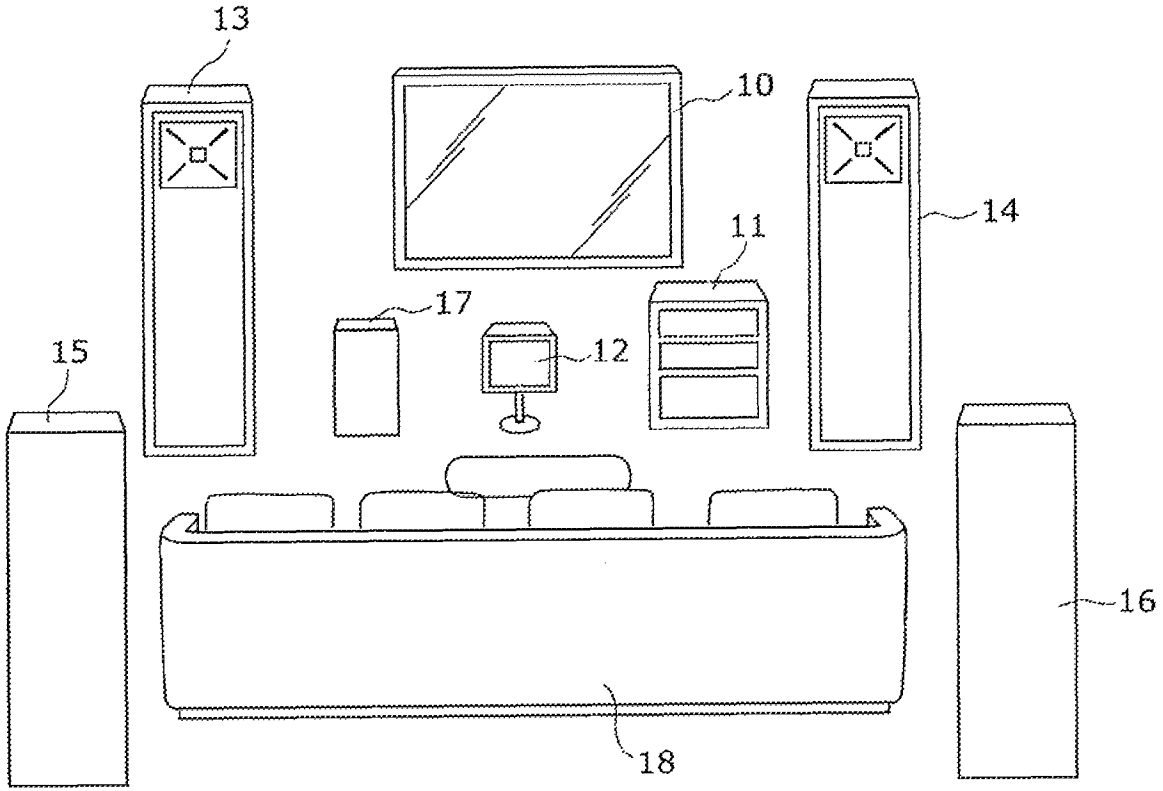
FIG. 3 is a diagram which shows an outline view of a home theater system including an audio reproduction apparatus according to Embodiment 1 of the present invention.

FIG. 3 is a diagram which shows an outline view of a home theater system including an audio reproduction apparatus according to Embodiment 1 of the present invention. The home theater system shown in the diagram includes: a monitor 10; a deck 11; a center channel speaker 12; a front L channel speaker 13; a front R channel speaker 14; a side L channel speaker 15; a side R channel speaker 16; and a low frequency effect (LFE) channel speaker 17. The reference numeral 18 represents a viewing space, such as a couch, in which a user uses the home theater system. The audio reproduction apparatus according to Embodiment 1 shown in FIG. 3 is a set-top box, for example, and stored in the deck 11.

Figure 4:
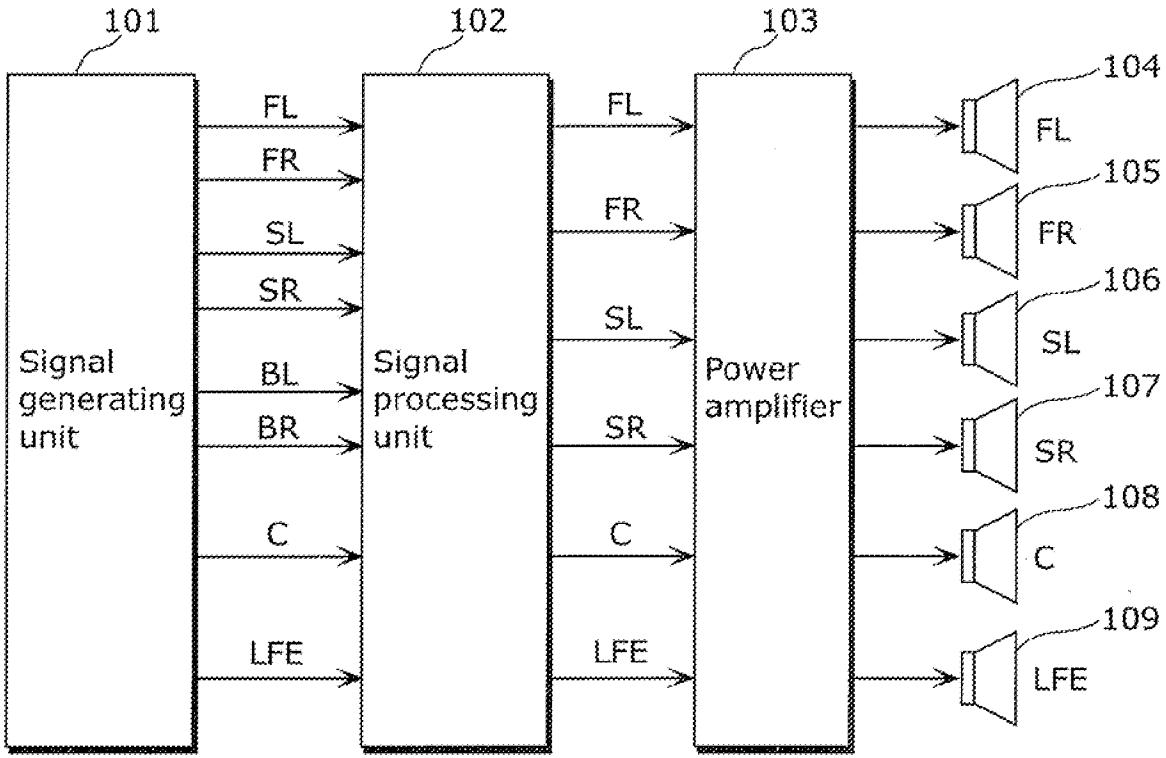
FIG. 4 is a block diagram which shows the audio reproduction apparatus according to Embodiment 1 of the present invention.

FIG. 4 is a block diagram of the audio reproduction apparatus 10 according to Embodiment 1 of the present invention. The audio reproduction apparatus shown in FIG. 4 reproduces 7.1-channel signals in a sound field that corresponds to 11.1 channels, using a 5.1-channel speaker system.

In FIG. 4, a signal generating unit 101 generates multichannel audio signals of 7.1 channels; that is, a front L channel signal (FL signal), a front R channel signal (FR signal), a surround L channel signal (SL signal), a surround R channel signal (SR signal), a surround back L channel signal (BL signal), a surround back R channel signal (BR signal), a center channel signal (C signal), and a low frequency effect channel signal (LFE signal). As a specific example, the signal generating unit 101 is a blu-ray disc including 7.1-channel audio signal content and a reproduction player for reproducing the blu-ray disc. The signal processing unit 102 performs signal processing on an output signal of the signal generating unit 101 for reproducing, using a 5.1-channel speaker system, a sound field corresponding to a sound field reproduced by a 11.1-channel speaker system. A power amplifier 103 performs power amplification on the output signal of the signal processing unit 102. The speaker 104 is a speaker for a front L channel (FL speaker), a speaker 105 is a speaker for a front R channel (FR speaker), a speaker 106 is a speaker for a surround L channel (SL speaker), a speaker 107 is a speaker for a surround R channel (SR speaker), a speaker 108 is a speaker for a center channel (C speaker), and a speaker 109 is a speaker for a low frequency effect channel (LFE speaker). These speakers 104 to 109 are included in the 5.1-channel speaker system. For example, the speakers 104 to 109 configure the surround speaker system in the home theater system shown in FIG. 3.

Figure 5:
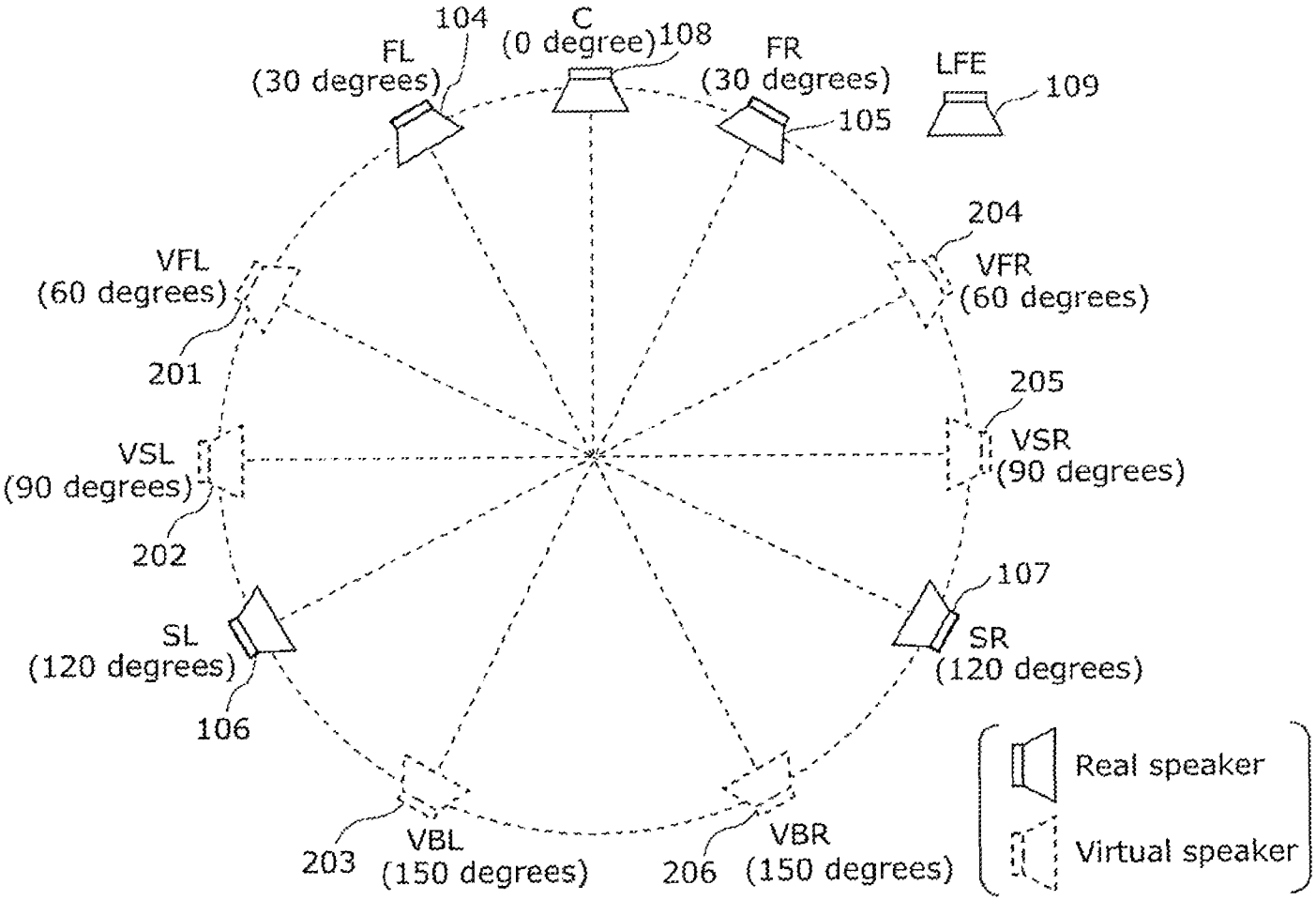
FIG. 5 is a diagram which explains a speaker placement according to Embodiment 1 of the present invention.

FIG. 5 shows a placement of virtual speakers 201 to 206 to be realized and the speakers 104 to 109 which are actually present, in the audio reproduction apparatus according to Embodiment 1 of the present invention.

Figure 6:
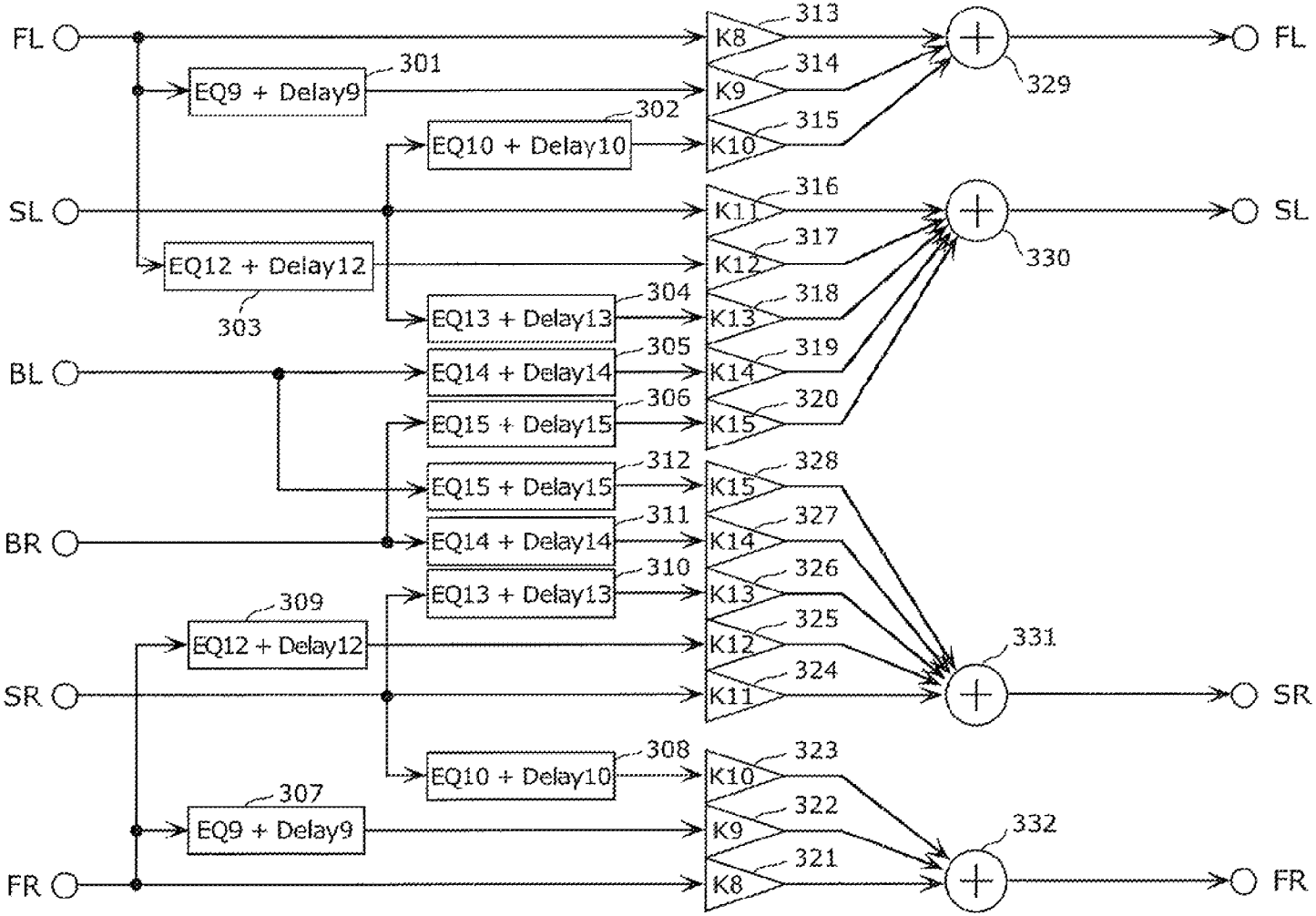
FIG. 6 is a block diagram which shows a signal processing unit according to Embodiment 1 of the present invention.

FIG. 6 shows a specific configuration of the signal processing unit 102, and 301 to 312 denote delay equalizers in each of which an equalizer and a delay are connected by cascade connection, 313 to 328 denote level adjusters which adjust levels of output signals of the delay equalizers 301 to 312, and 329 to 332 denote adders which add output signals of the level adjusters 313 to 328.

Figure 7:
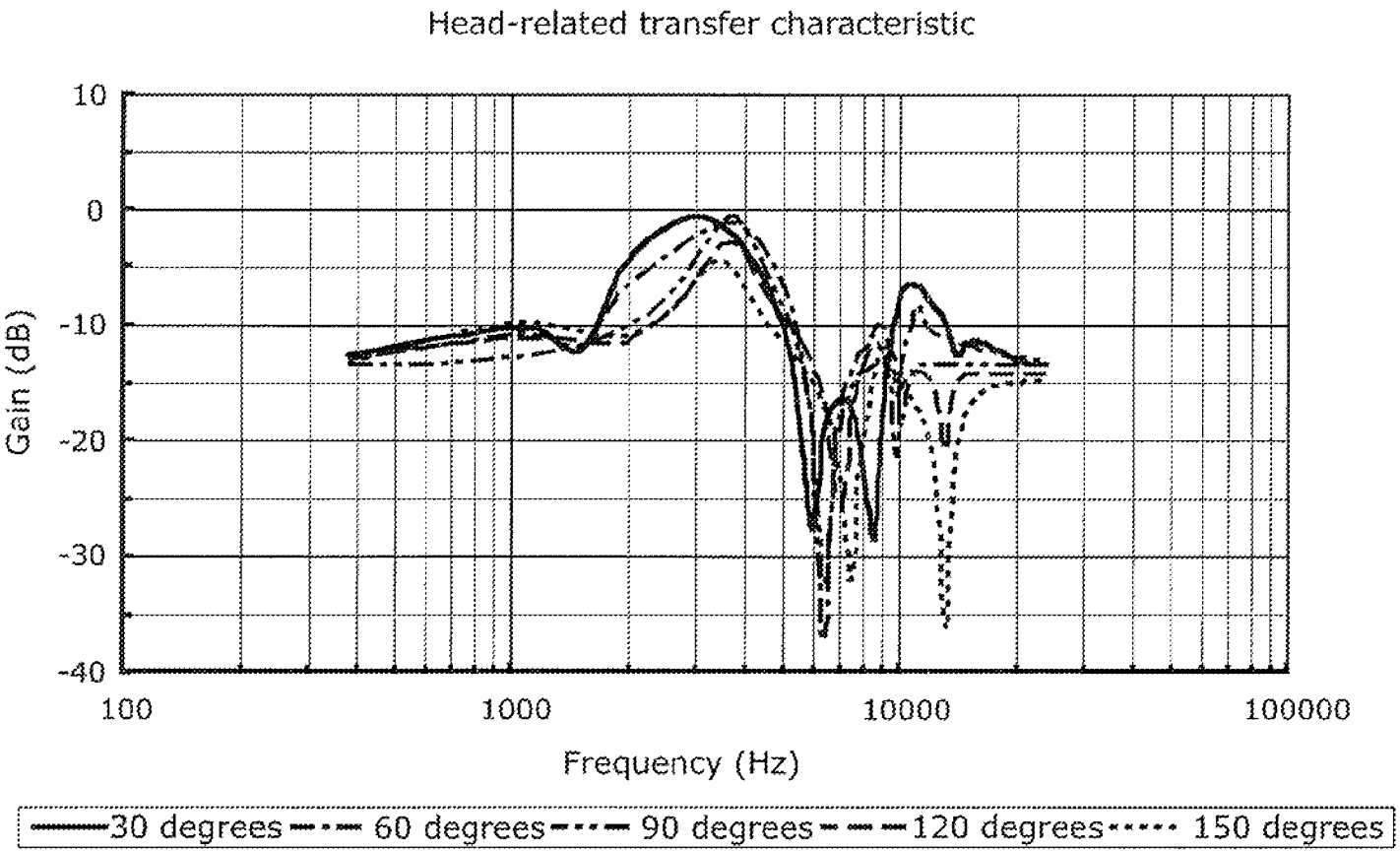
FIG. 7 is a characteristic diagram which shows head-related transfer characteristic.

FIG. 7 shows an example of the head-related transfer characteristic from a sound source to an ear on the same side as the sound source when an angle at which a sound source is presented is changed.

Figure 8:
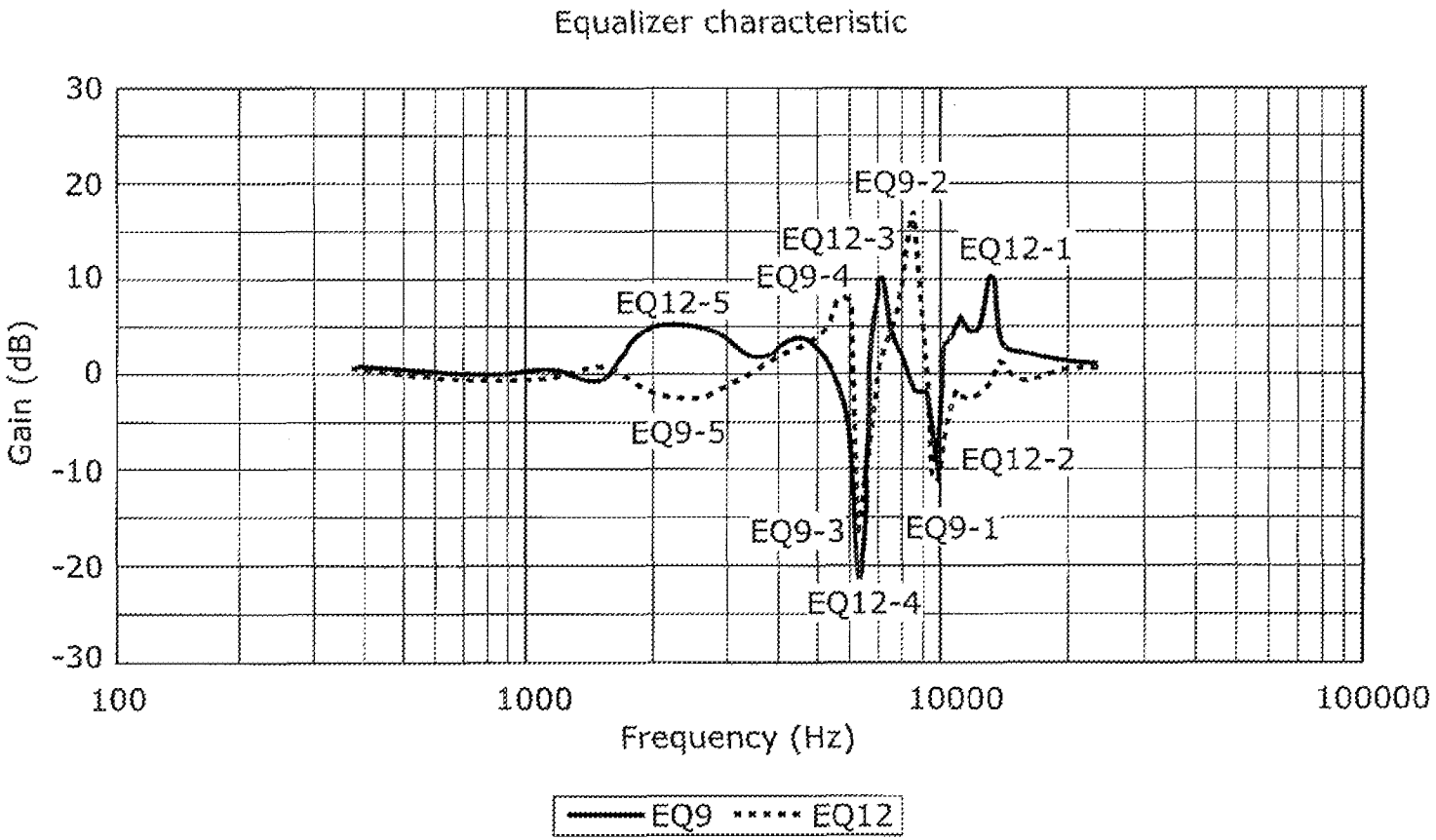
FIG. 8 is a characteristic diagram which shows frequency characteristic of an equalizer according to Embodiment 1 of the present invention.

FIG. 8 shows an example of the frequency characteristic of the equalizer characteristic EQ9 and the equalizer characteristic EQ12 shown in FIG. 6.

The following describes in details operations related to Embodiment 1 according to the present invention configured as above.

Figure 1:
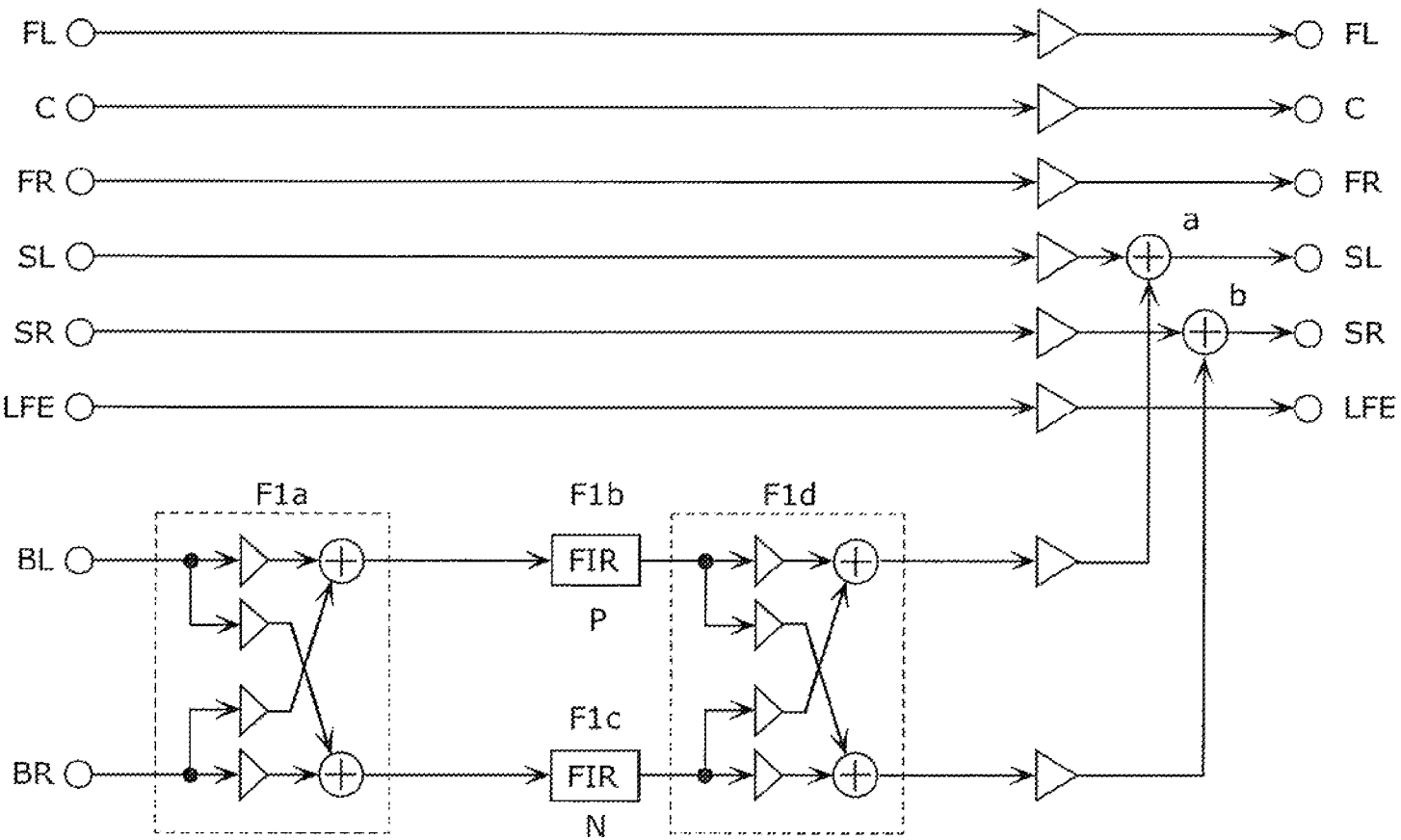
FIG. 1 is a block diagram which shows a conventional audio reproduction apparatus.
Figure 2:
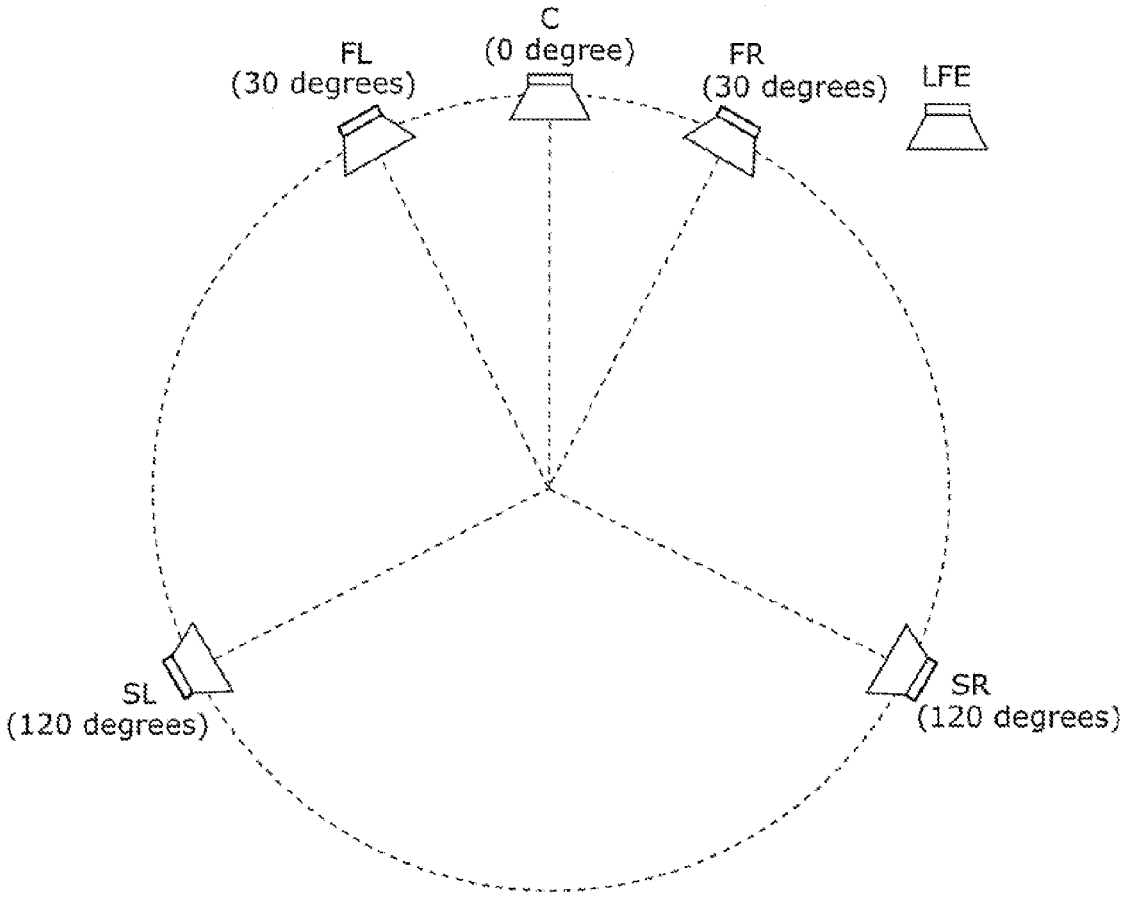
FIG. 2 shows a diagram of a speaker placement according to the ITU-RBS. 775-1 recommendation.

Audio signals of 7.1 channels output from the signal generating unit 101 are provided to the signal processing unit 102. In Embodiment 1 according to the present invention, signal processing is performed on content of 7.1 channels for reproducing, with the 5.1-channel speaker system, a sound field that is created when the content is reproduced with an 11.1-channel speaker system configuration including the real speakers and the virtual speakers shown in FIG. 5. The placement of the 5.1-channel speaker system is assumed here as being the speaker placement defined by the ITU (International Telecommunication Union)-R B510 TG10/1 recommendation 775-1 as shown in FIG. 2; that is, a center speaker is placed at 0 degree, a front speaker is placed at 30 degrees both in the left and right side, and a surround speaker is placed at 120 degrees both in the left and right side, in a concentric fashion, with respect to a viewer.

Meanwhile, as virtual speakers to be realized other than the real speakers, a virtual speaker 203 (VBL speaker) for the surround back channel which reproduces a surround back channel L signal (BL signal) and a virtual speaker 206 (VBR speaker) for the surround back channel which reproduces a surround back channel R signal (BR signal) are placed. The surround back channel L signal and the surround back channel R signal are included in content to be reproduced.

In addition, since there is a 90 degree angular interval between a front channel speaker and a surround channel speaker in each of the left side and the right side with the speaker placement for the 5.1 channels or the 7.1 channels, there is a lack of the sense of seamless sound field between the front channel and the surround channel. In order to improve this, a virtual speaker 201 (VFL speaker) for localization of the FL signal and a virtual speaker 202 (VSL speaker) for localization of the SL signal are placed at the positions of 60 degrees and 90 degrees between the speaker 104 (FL speaker) and the speaker 106 (SL speaker). In the same manner as above, a virtual speaker 204 (VFR speaker) for localization of the FR signal and a virtual speaker 205 (VSR speaker) for localization of the SR signal are placed at the positions of 60 degrees and 90 degrees between the speaker 105 (FR speaker) and the speaker 107 (SR speaker).

Accordingly, in Embodiment 1 of the present invention, the 5.1-channel speaker system reproduces the sound field that is to be reproduced by each of the 11.1-channel speakers; that is, C (0 degree), FL (30 degrees on the left), FR (30 degrees on the right), VFL (60 degrees on the left), VFR (60 degrees on the right), VSL (90 degrees on the left), VSR (90 degrees on the right), SL (120 degrees on the left), SR (120 degrees on the right), VBL (150 degrees on the left), VBR (150 degrees on the right), and LFE.

The following describes a method of reproducing a reproduced sound from a virtual speaker corresponding to a non-existent channel, using a real speaker that is actually present.

This is implemented using two real speakers A and B which are actually present in such a manner as sandwiching a placement angle of a virtual speaker V to be realized. By reproducing the same sound source from two speakers, it is possible to generate a synthesized sound of reproduced sounds from the two speakers such that a sound source is localized at a position of a vector synthesis resulting from being weighted by a level ratio. More specifically, when it is assumed that an angle between the real speaker A and the virtual speaker V is a, an angle between the real speaker B and the virtual speaker V is b, and an angle between the real speaker A and the real speaker B is c, as viewed from a viewing position, a sound image is localized at a position of the virtual speaker V when levels PA and PB of the speakers A and B are represented as Expression. 3 and Expression. 4, respectively; that is, the ratio of PA to PB is represented as Expression. 5.

[Math. 3]

$$PA = \frac{|\sin b|}{|\sin c|} \qquad \text{Expression 3}$$

[Math. 4]

$$PB = \frac{|\sin a|}{|\sin c|} \qquad \text{Expression 4}$$

となるとき，すなわち，*PA*と*PB*の比が

[Math. 5]

$$\frac{PA}{PB} = \frac{|\sin b|}{|\sin a|} \qquad \text{Expression 5}$$

Humans feel a sound with an ear, and the sound that transmits to the ear includes, other than a direct sound from a sound source, a sound that transmits via a human body, especially a head part. For that reason, the transmission characteristic of a sound from the sound source to the ear has the frequency characteristic due to the effect of the human body, especially the head part and an auricle. This is called head-related transfer characteristics. The reason why humans can identify a position of a sound source is considered to be that humans can comprehend the head-related transfer characteristic and angular dependency. FIG. 7 shows an example for the head-related transfer characteristic.

FIG. 7 shows the frequency characteristic of the transfer function from each of the speakers to the left ear of the viewer when each of the speakers is placed at corresponding one of the positions at 30 degrees, 60 degrees, 90 degrees, 120 degrees, and 150 degrees, in a counterclockwise direction viewed from the front of the viewer.

According to Embodiment 1 of the present invention, the human mechanism of identifying a sound localization position is applied to controlling of the frequency characteristic from the real speaker so that the head-related transfer characteristic from the virtual speaker is provided to a viewer, using the relationship between placement angles of a virtual speaker to be implemented and a real speaker that is actually present, thereby allowing the viewer to feel that a sound is coming from; that is, a sound is localized at, the virtual speaker to be implemented.

Thus, when a sound is to be localized at a position of a virtual speaker V using two real speakers A and B which sandwich a virtual speaker V, a signal to be localized is caused to pass through an equalizer having the characteristic of (the head-related transfer characteristic from the virtual speaker V to an ear of the viewer)÷(the head-related transfer characteristic from the real speaker A to the ear of the viewer) and to be output to the real speaker A, while the signal to be localized is caused to pass through an equalizer having the characteristic of (the head-related transfer characteristic from the virtual speaker V to an ear of the viewer)÷(the head-related transfer characteristic from the real speaker B to the ear of the viewer) and to be output to the real speaker B. More specifically, it can be said that the equalizer characteristic of (the head-related transfer characteristic from the virtual speaker V to an ear of the viewer)÷(the head-related transfer characteristic from the real speaker A to the ear of the viewer) is an equalizer characteristic that converts the characteristic of an audio signal that is perceived to be reproduced at a position of the real speaker A viewed from the viewing position into a characteristic that is perceived to be reproduced at a position of the virtual speaker V viewed from the viewing position, and that the equalizer characteristic of (the head-related transfer characteristic from the virtual speaker V to an ear of the viewer)+(the head-related transfer characteristic from the real speaker B to the ear of the viewer) is an equalizer characteristic that converts the characteristic of an audio signal that is perceived to be reproduced at a position of the real speaker B viewed from the viewing position into a characteristic that is perceived to be reproduced at a position of the virtual speaker V viewed from the viewing position.

It is to be noted that, since a viewer has an ear on both the left side and the right side, each of the head-related transfer characteristics described above includes two types; that is, the head-related transfer characteristic to the left ear and the head-related transfer characteristic to the right ear. However, in practice, the head-related transfer characteristic to the ear on the same side as the virtual speaker V is predominant, and thus, the head-related transfer characteristic to the ear on the side opposite to the virtual speaker can be ignored.

According to Embodiment 1 of the present invention as described above, a reproduction level and the frequency characteristic of the real speakers sandwiching a placement angle of the virtual speaker to be implemented are controlled, thereby reproducing, with a limited real speaker system, a reproduced sound from a speaker system including virtual speakers placed at various angles.

The following explains FIG. 6 which shows a detailed configuration of the signal processing unit 102 for realizing the virtual speakers shown in FIG. 5. The following only describes the L side because the same processing is carried out as being bilaterally symmetric. In addition, the C and LFE channels are not illustrated because they only carry out the processing of adding a processing delay that occurs in the signal processing unit 102.

As shown in FIG. 5, the virtual speaker 201 (VFL speaker) and the virtual speaker 202 (VSL speaker) are placed between the speaker 104 (FL speaker) and the speaker 106 (SL speaker), the virtual speaker 201 and the virtual speaker 202 are reproduced by the two speakers 104 and 106.

A signal to be localized at the virtual speaker 201 (VFL speaker) is obtained by processing the FL signal using the delay equalizer 301, the delay equalizer 303, the level adjuster 314, and the level adjuster 317.

The equalizer characteristic EQ9 of the delay equalizer 301 implements (the head-related transfer characteristic in the direction of 60 degrees)÷(the head-related transfer characteristic in the direction of 30 degrees), and may be a result of calculation using the head-related transfer characteristic itself, may only be an amplitude characteristic of the result of the calculation using the head-related transfer characteristic itself, or may be a simplified implementation of the amplitude characteristic of the result of the calculation using the head-related transfer characteristic itself. As a simplified implementation method, a graphic equalizer for ⅓ oct band width or the like may be used, or a parametric equalizer may be used which can extract approximately five points in ascending or descending order of an amplitude level in a band of 1 kHz or higher of the calculated amplitude characteristic and determine the characteristic with a center frequency, a Q value, and the amplitude level. The equalizer characteristic EQ12 of the delay equalizer 303 implements (the head-related transfer characteristic in the direction of 60 degrees)÷(the head-related transfer characteristic in the direction of 120 degrees). Based on Expression 3 and Expression 4 described above, a coefficient K9 of the level adjuster 314 is calculated as 0.87 and a coefficient K12 of the level adjuster 317 is calculated as 0.5. FIG. 8 shows a frequency characteristics of each of the equalizer characteristics EQ9 and EQ12.

In the same manner as above, a signal to be localized at the virtual speaker 202 (VSL speaker) is obtained by processing the SL signal using the delay equalizer 302, the delay equalizer 304, the level adjuster 315, and level adjuster 318. The equalizer characteristic EQ10 of the delay equalizer 302 implements (the head-related transfer characteristic in the direction of 90 degrees)÷(the head-related transfer characteristic in the direction of 30 degrees). The equalizer characteristic EQ13 of the delay equalizer 304 implements (the head-related transfer characteristic in the direction of 90 degrees)÷(the head-related transfer characteristic in the direction of 120 degrees). Based on Expression 3 and Expression 4 described above, a coefficient K10 of the level adjuster 315 is calculated as 0.5 and a coefficient K13 of the level adjuster 318 is calculated as 0.87.

In addition, since the virtual speaker 203 (VBL speaker) is placed between the speaker 106 (SL speaker) and the speaker 107 (SR speaker), the virtual speaker 203 is reproduced by the two speakers 106 and 107.

A signal to be localized at the virtual speaker 203 (VBL speaker) is obtained by processing the BL signal using the delay equalizer 305, the delay equalizer 312, the level adjuster 319, and level adjuster 328. The equalizer characteristic EQ14 of the delay equalizer 305 implements (the head-related transfer characteristic in the direction of 150 degrees on the left)÷(the head-related transfer characteristic in the direction of 120 degrees on the left). The equalizer characteristic EQ15 of the delay equalizer 312 implements (the head-related transfer characteristic in the direction of 150 degrees on the left)÷(the head-related transfer characteristic in the direction of 120 degrees on the right). Based on Expression 1 and Expression 2 described above, a coefficient K14 of the level adjuster 319 is calculated as 0.89 and a coefficient K15 of the level adjuster 328 is calculated as 0.45.

It is to be noted that, since only the head-related transfer characteristic to the ear on the same side as the virtual speaker needs to be considered as described above, the equalizer characteristic EQ15 of the delay equalizer 312 is only necessary to implement (the head-related transfer characteristic to the left ear in the direction of 150 degrees on the left)÷(the head-related transfer characteristic to the left ear in the direction of 120 degrees on the right).

In addition, when implementing an equalizer with a parametric equalizer of 5 bands, the characteristic is approximated such that five characteristic peaks and dips (EQ9-1 to EQ9-5, EQ12-1 to EQ12-5) of the equalizer characteristic calculated based on the head-related transfer characteristic are included as show in FIG. 8.

The signals processed as described above are subject to adding processing performed by the adders 329 to 332 to generate output signals.

The adder 329 outputs a signal to the speaker 104 (FL speaker). The adder 329 adds an output signal of the level adjuster 313 that performs level adjustment of the input FL signal, an output signal of the level adjuster 314 on which a process for realizing the VFL speaker is performed, and an output signal of the level adjuster 314 on which a process for realizing the VSL speaker is performed.

In the same manner as above, the adder 330 outputs a signal to the speaker 106 (SL speaker). The adder 330 adds an output signal of the level adjuster 316 that performs level adjustment of the input SL signal, an output signal of the level adjuster 317 on which a process for realizing the VFL speaker is performed, an output signal of the level adjuster 318 on which a process for realizing the VSL speaker is performed, an output signal of the level adjuster 319 on which a process for realizing the VBL speaker is performed, and an output signal of the level adjuster 320 on which a process for realizing the VBR speaker is performed. Here, a coefficient K8 of the level adjuster 313 and a coefficient K11 of the level adjuster 316 are coefficients whose levels do not basically change due to an input or output; however, the levels may be changed according to the subjective degree of effects of the realistic sensation.

The following explains an effect of a delay dependently connected to the equalizer.

The FL signal and the SL signal are the original signals for realizing the VFL speaker and the VSL speaker as in the FL speaker and the SL speaker, respectively. Thus, since a sound source representing the status of a field is heard in a manner that a sound pressure is distributed in a wide range, it is highly effective for increasing spaciousness of the sound field, "surrounded feeling" that is the sense to be surrounded by sounds, and the like. However, as to a sound source that is intended for sound localization at a specific position, localization tends to be imprecise because the same sound source is reproduced at several positions.

Meanwhile, there is the precedence effect (Haas effect) that is a phenomenon that, when the same sound is transmitted from plural sound sources, a sound image is localized in a direction of a sound that has first arrived at a human's ear, which is effective in a range shorter than approximately 25 to 35 msec. This phenomenon is used for delaying a sound corresponding to the VFL speaker and the VSL speaker by approximately 1 msec with respect to a sound from the FL speaker and the SL speaker, thereby allowing a clear sound localization at the position of each of the FL speaker and the SL speaker while preventing the connection with the sound from the VFL speaker and the VSL speaker from being impaired.

As described above, the audio reproduction apparatus according to Embodiment 1 of the present invention controls the frequency characteristic and the level of an audio signal that is to be input such that the audio signal is added and distributed to the speakers which are placed, thereby obtaining sound image localization of 11.1 channels and realistic sensation with the 5.1 channel speaker configuration. In addition, since several types of technique of frequency characteristic based on the head-related transfer characteristic are presented, it is possible to select, for configuration, from (i) increasing accuracy of the effect (in the case of precisely calculating and processing the equalizer characteristic based on the head-related transfer characteristic), (ii) reducing implementation costs (in the case of focusing specifically on the amplitude characteristic of the frequency characteristic and implementing the frequency characteristic based on the head-related transfer characteristic with a graphic equalizer or a parametric equalizer), and (iii) reducing the differences in the head-related transfer function among individuals (in the case of reproducing only the amplitude characteristic of the frequency characteristic and implementing an outline of the frequency characteristic by focusing on the peaks and dips of the frequency characteristics in a band of 1 kHz or higher).

According to Embodiment 1 of the present invention, the front channels are allocated to the virtual speakers in the directions of 60 degrees and the surround channels are allocated to the virtual speakers in the directions of 90 degrees. It is to be understood that the differences in a subjective amount among individuals or the effect according to the viewing environment (the state of the room and the placement of the real speakers) can be adjusted by allocating the surround channels to both of the virtual speakers in the directions of 60 degrees and in the directions of 90 degrees or allocating both the front channels and the surround channels to the virtual speaker in the direction of 60 degrees.

In addition, in Embodiment 1 of the present invention, the input signal is explained as being for 7.1 channels. However, it is to be understood that, when the input signal is for 6.1 channels, the amplitude of a signal of the surround back channel is reduced by 3 dB and the signal is input to each of the L channel and the R channel of the surround back, thereby enabling implementation of the 7.1 channels. Furthermore, when the input signal is for 5.1 channels, signals of the surround L channel and the surround R channel are input instead of signals of the surround back L channel and the surround back R channel, thereby enabling implementation of the 7.1 channels.

In addition, in Embodiment 1 of the present invention, the head-related transfer characteristic according to the differences in angles in the horizontal plane is used. However, it is to be understood that, by using the head-related transfer characteristic to which information on angles in the vertical plane is added, it is possible to control the localization position by changing the localization position of the virtual speakers to the vertical direction as well, in addition to the horizontal direction. In this case, according to Embodiment 1 of the present invention, it is to be understood that the effect is improved by providing the FL signal to be transmitted to the FL speaker, the FR signal to be transmitted to the FR speaker, the SL signal to be transmitted to the SL speaker, and the SR signal to be transmitted to the SR speaker which are not provided with the equalizer with an equalizer based on the head-related transfer characteristic according to the differences in angles in the vertical direction.

In addition, in Embodiment 1 of the present invention, the placement of the real speakers is explained as being in line with the placement positions of the ITU-RBS. 775-1 recommendation. However, it is to be understood that the placement is not limited to this, and the same effects can be obtained by adjusting a parameter according to the placement angle of each of the real speakers.

In addition, it is to be understood that, since the placement state of speakers differs for each placement state adapted by a viewer, it is possible to provide the maximum effect of Embodiment 1 of the present invention by measuring the distance between a viewing point and a speaker, the placement angle, the sound pressure level, and so on in the placement state adapted by the viewer and adjusting a parameter based on the measurement result.

In addition, it is to be understood that the effect suitable to a viewer or content can be obtained by allowing a viewer side to arbitrarily change the placement angle or level adjustment.

In addition, it has been described that the audio reproduction apparatus includes five real speakers having a pair of surround speakers (that is, the SL speaker and the SR speaker) in order to show that the audio reproduction apparatus can be configured with speakers of minimum configuration. However, it is to be understood, that even when two or more pairs of the surround speakers are included, it is possible to configure the audio reproduction apparatus by using two real speakers which sandwich a speaker to be realized.

Embodiment 2

The following describes in detail an operation and each of the elements of an audio reproduction apparatus according to Embodiment 2 of the present invention.

Figure 9:
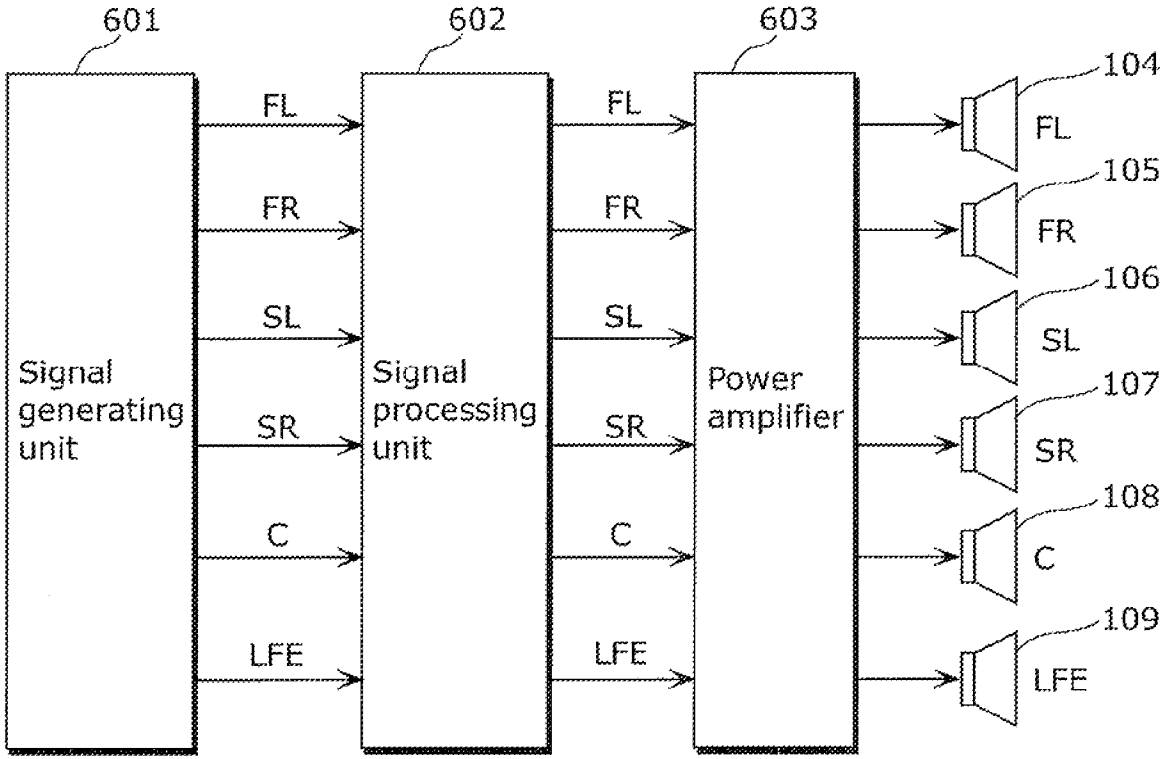
FIG. 9 is a block diagram which shows an audio reproduction apparatus according to Embodiment 2 of the present invention.

FIG. 9 is a block diagram of the audio reproduction apparatus according to Embodiment 2 of the present invention. The audio reproduction apparatus shown in FIG. 9 reproduces SL signals and SR signals included in 5.1 channels, using a 5.1-channel speaker system, by distributing, and causing to be localized, the signals, to positions of ten virtual speakers placed on right, left, and back walls.

In FIG. 9, the reference numeral 601 denotes a signal generating unit which generates a multi-channel audio signal of the 5.1 channels. The reference numeral 602 denotes a signal processing unit for performing signal processing on an output signal of the signal generating unit 601 and causing a surround signal to be localized at the positions of ten virtual speakers. The reference numeral 603 denotes a power amplifier which performs power amplification on an output signal of the signal processing unit 602. The reference numerals 104 to 109 denote speakers included in the 5.1-channel speaker system (FL speaker, FR speaker, SL speaker, SR speaker, C speaker, and LFE speaker).

Figure 10:
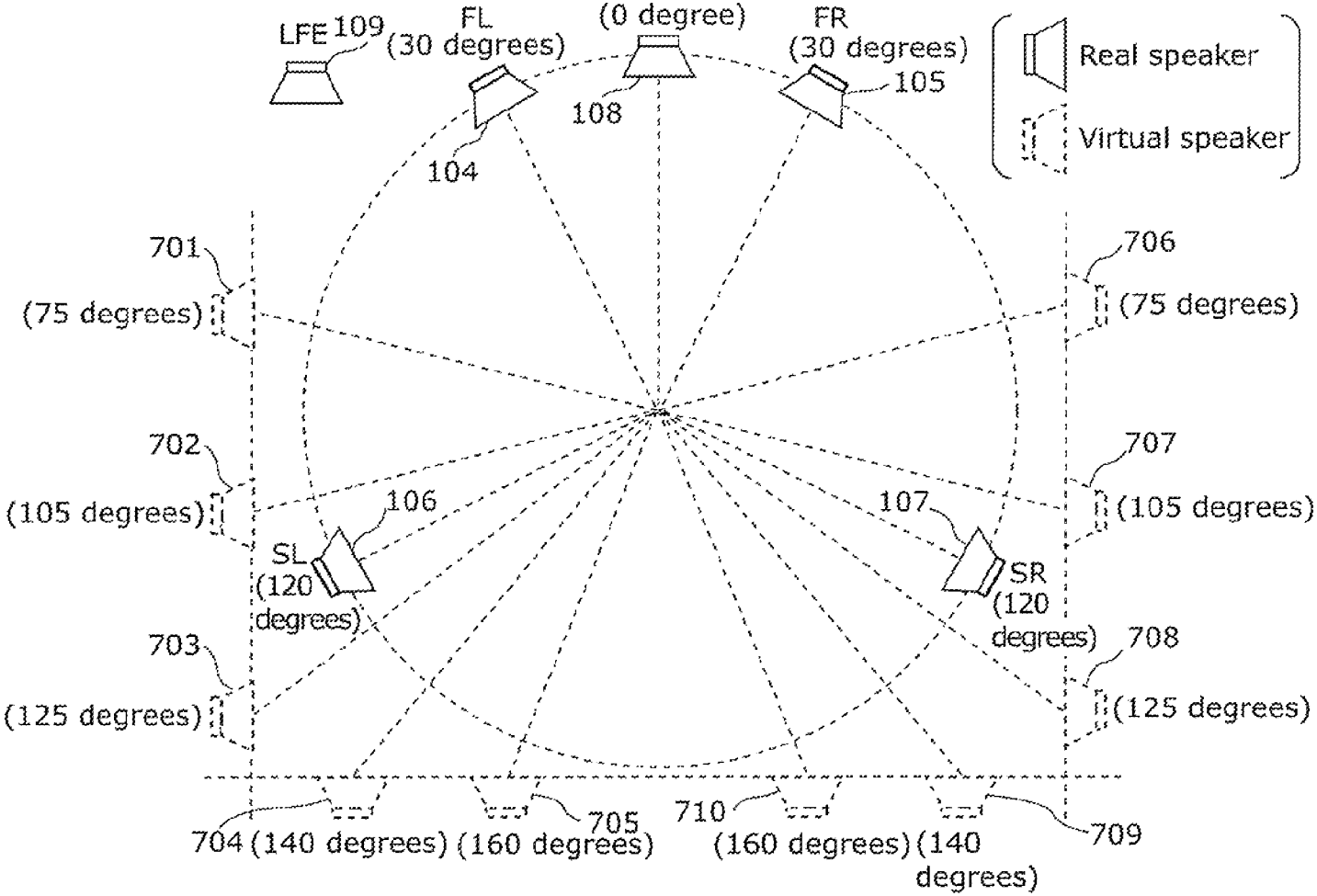
FIG. 10 is a diagram which explains a speaker placement according to Embodiment 2 of the present invention.

FIG. 10 shows a placement of virtual speakers to be realized and real speakers which are actually present in the audio reproduction apparatus according to Embodiment 2 of the present invention.

In FIG. 10, the reference numerals 701, 702, and 703 denote virtual speakers for reproducing SL signals by causing the SL signals to be localized at 75 degrees, 105 degrees, and 125 degrees, respectively, on a left wall. The reference numerals 704 and 705 denote virtual speakers for reproducing SL signals by causing the SL signals to be localized at 140 degrees and 160 degrees, respectively, on a back wall. The reference numerals 706, 707, and 708 denote virtual speakers for reproducing SR signals by causing the SR signals to be localized at 75 degrees, 105 degrees, and 125 degrees, respectively, on a right wall. The reference numerals 709 and 710 denote virtual speakers for reproducing SR signals by causing the SR signals to be localized at 140 degrees and 160 degrees, respectively, on a back wall. The speaker placement shown here corresponds to the speaker placement in a movie theater or a dubbing stage for creating a sound for movie content.

Figure 11:
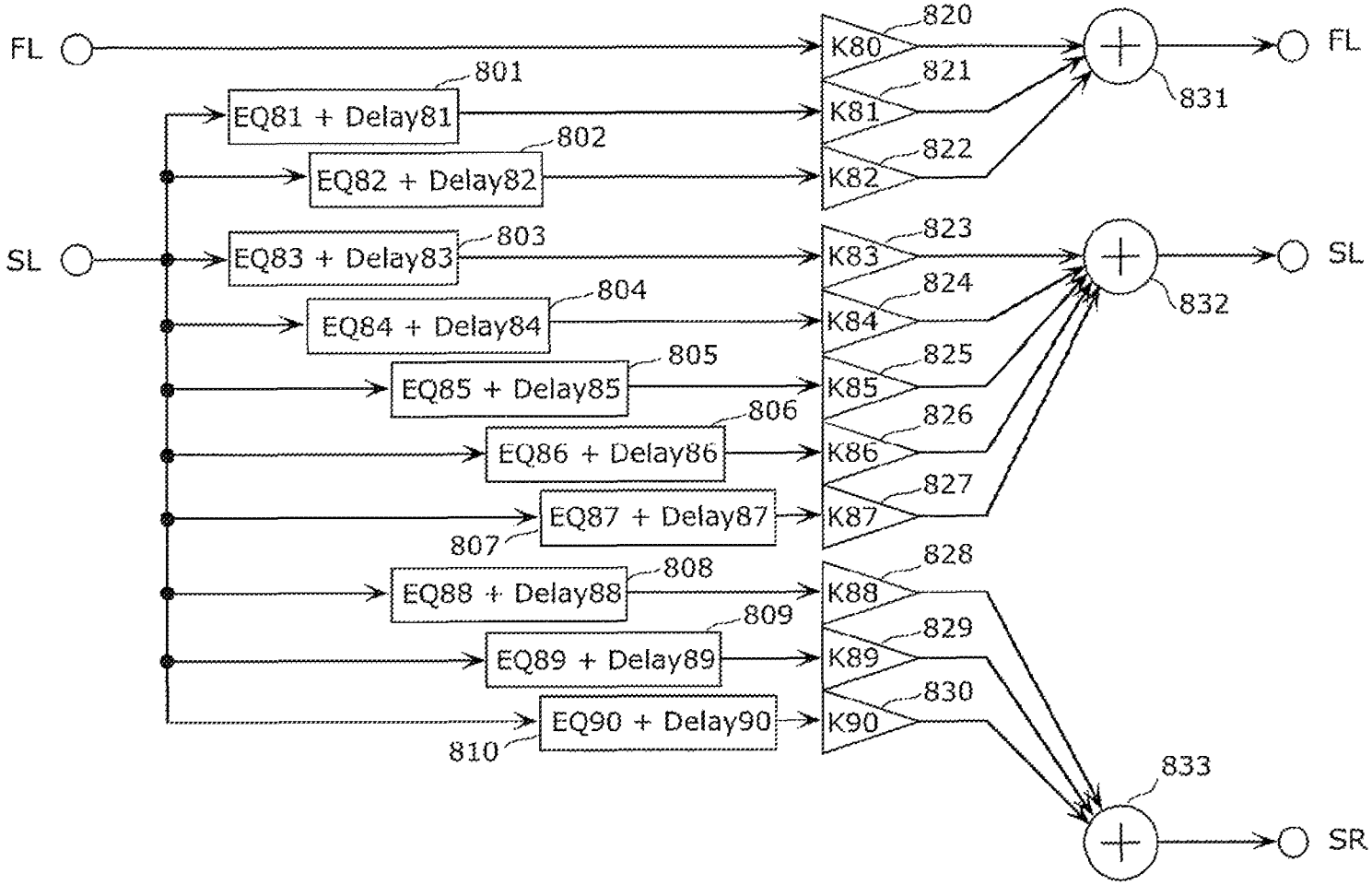
FIG. 11 is a block diagram which shows a signal processing unit according to Embodiment 1 of the present invention.

FIG. 11 shows a specific configuration of a block, in the signal processing unit 602, for causing the SL signals to be localized at virtual speakers 701 to 705, and a block for causing the SL signals to be localized at virtual speakers 706 to 710 are the same and thus omitted.

In FIG. 11, the reference numerals 801 to 810 denote delay equalizers in each of which an equalizer and a delay are connected by cascade connection, the reference numerals 821 to 830 denote level adjusters which adjust a level of output signals of the delay equalizers 801 to 810, and the reference numerals 831 to 833 denote adders which add output signals of the level adjusters 820 to 830.

The following describes operations related to Embodiment 2 according to the present invention configured as above.

Audio signals of the 5.1 channels output from the signal generating unit 601 are provided to the signal processing unit 602. Signal processing is performed on content of the 5.1 channels for reproducing, with the 5.1-channel speaker system, a sound field that is created when the content is reproduced using the virtual speakers 701 to 710 shown in FIG. 10. It is assumed here that the speaker placement in the 5.1 channel speaker system is the speaker placement defined by the ITU-R BS10 TG10/1 recommendation 775-1.

Meanwhile, the placement of the virtual speakers 701 to 710 to be realized corresponds to the speaker placement in a movie theater or a dubbing stage for creating a sound for movie content. The speaker placement for the movie theater or the dubbing stage includes plural surround channel reproduction speakers, unlike the speaker placement of the ITU-R recommendation with which the speaker placement in a home theater system is compliant. A Diffuse sound field is created because the plural surround channel reproduction speakers are included, and thus a natural sense of sound field is created without being aware of the speakers. Movie content is created under such a reproduction environment and screened. On the other hand, the home theater system basically includes a pair of surround speakers, and thus it is difficult to reproduce the diffuse sound field described above. An object of Embodiment 2 of the present invention is to reproduce a sound field that is reproduced by plural surround channel speakers, using a 5.1-channel reproduction apparatus including a pair of surround speakers.

According to Embodiment 2 of the present invention, a sound field configured by a total of 14 speakers including C (0 degree), FL (30 degrees on the left), FR (30 degrees on the right), LFE, and virtual speakers 701 to 710 is reproduced by the speakers including C (0 degree), FL (30 degrees on the left), FR (30 degrees on the right), SL (120 degrees on the left), and SR (120 degrees on the right) which configure a 5.1-channel speaker system.

The technique described in Embodiment is used for a method of reproducing a reproduced sound (in particular, sound source localization) from a speaker system that corresponds to a channel that is not present in a real speaker system.

The following explains a detailed configuration of the signal processing unit 602 shown in FIG. 11. The following only describes the L channel because the same processing is carried out as being bilaterally symmetric. The configuration blocks related to an R channel are not described for that reason. In addition, the C and the LFE channels are not illustrated because they only carry out the processing of adding a processing delay that occurs in the signal processing unit 602.

As shown in FIG. 10, the virtual speaker 701 positioned at 75 degrees and the virtual speaker 702 positioned at 105 degrees are placed between the speaker 104 (FL speaker) positioned at 30 degrees and the speaker 106 (SL speaker) positioned at 120 degrees, and thus reproduced by the speaker 104 and the speaker 106.

For causing localization at the position of the virtual speaker 701, an SL signal is processed by the delay equalizer delay equalizer 801, the delay equalizer 803, the level adjuster 821, and the level adjuster 823. The equalizer characteristic EQ81 of the delay equalizer 801 implements (the head-related transfer characteristic in the direction of 75 degrees)÷(the head-related transfer characteristic in the direction of 30 degrees), and may be a result of calculation using the head-related transfer characteristic itself, may only be an amplitude characteristic of the result of the calculation using the head-related transfer characteristic itself, or may be a simplified implementation of the amplitude characteristic of the result of the calculation using the head-related transfer characteristic itself. As a simplified implementation method, a graphic equalizer for ⅓ oct band width or the like may be used, or a parametric equalizer may be used, which can extract approximately five points in ascending or descending order of an amplitude level in a band of 1 kHz or higher of the calculated amplitude characteristic and determine the characteristic with a center frequency, Q value, and the amplitude level. The equalizer characteristic EQ83 of the delay equalizer 803 implements (the head-related transfer characteristic in the direction of 75 degrees)÷(the head-related transfer characteristic in the direction of 120 degrees). Based on Expression 3 and Expression 4 described above, a coefficient K81 of the level adjuster 821 is calculated as 0.71 and a coefficient K83 of the level adjuster 823 is calculated as 0.71.

In the same manner as above, for causing localization at the position of the virtual speaker 702, an SL signal is processed by the delay equalizer delay equalizer 802, the delay equalizer 804, the level adjuster 822, and the level adjuster 824. The equalizer characteristic EQ82 of the delay equalizer 802 implements (the head-related transfer characteristic in the direction of 105 degrees)÷(the head-related transfer characteristic in the direction of 30 degrees). The equalizer characteristic EQ84 of the delay equalizer 804 implements (the head-related transfer characteristic in the direction of 105 degrees)÷(the head-related transfer characteristic in the direction of 120 degrees). Based on Expression 3 and Expression 4 described above, a coefficient K82 of the level adjuster 822 is calculated as 0.26 and a coefficient K84 of the level adjuster 824 is calculated as 0.97.

In addition, since the virtual speaker 703, 704, and 705, which are positioned at 125 degrees, 140 degrees, and 160 degrees, respectively, are placed between the speaker 106 (SL speaker) positioned at 120 degrees on the left and the speaker 107 (SR speaker) positioned at 120 degrees on the right, the virtual speakers 703, 704, and 705 are reproduced by the speaker 106 and the speaker 107.

For causing localization at the position of the virtual speaker 703, an SL signal is processed by the delay equalizer 805, the delay equalizer 808, the level adjuster 825, and the level adjuster 828. The equalizer characteristic EQ85 of the delay equalizer 805 implements (the head-related transfer characteristic in the direction of 125 degrees on the left)÷(the head-related transfer characteristic in the direction of 120 degrees on the left). The equalizer characteristic EQ88 of the delay equalizer 808 implements (the head-related transfer characteristic in the direction of 125 degrees on the left)÷(the head-related transfer characteristic in the direction of 120 degrees on the right). Based on Expression 3 and Expression 4 described above, a coefficient K85 of the level adjuster 825 is calculated as 0.995 and a coefficient K88 of the level adjuster 828 is calculated as 0.096.

For causing localization at the position of the virtual speaker 704, an SL signal is processed by the delay equalizer 806, the delay equalizer 809, the level adjuster 826, and the level adjuster 829. The equalizer characteristic EQ86 of the delay equalizer 806 implements (the head-related transfer characteristic in the direction of 140 degrees on the left)÷(the head-related transfer characteristic in the direction of 120 degrees on the left). The equalizer characteristic EQ89 of the delay equalizer 809 implements (the head-related transfer characteristic in the direction of 140 degrees on the left)÷(the head-related transfer characteristic in the direction of 120 degrees on the right). Based on Expression 3 and Expression 4 described above, a coefficient K86 of the level adjuster 826 is calculated as 0.95 and a coefficient K89 of the level adjuster 829 is calculated as 0.33.

For causing localization at the position of the virtual speaker 705, an as SL signal is processed by the delay equalizer 807, the delay equalizer 810, the level adjuster 827, and the level adjuster 830. The equalizer characteristic EQ87 of the delay equalizer 807 implements (the head-related transfer characteristic in the direction of 160 degrees on the left)÷(the head-related transfer characteristic in the direction of 120 degrees on the left). The equalizer characteristic EQ90 of the delay equalizer 810 implements (the head-related transfer characteristic in the direction of 160 degrees on the left)÷(the head-related transfer characteristic in the direction of 120 degrees on the right). Based on Expression 3 and Expression 4 described above, a coefficient K87 of the level adjuster 827 is calculated as 0.84 and a coefficient K90 of the level adjuster 830 is calculated as 0.55.

The signals processed as described above are subject to adding processing performed by the adders 831 to 833 to generate output signals.

The adder 831 outputs a signal to the FL speaker, and adds an output signal from the level adjuster 820 that performs level adjustment of the input FL signal to output signals, from the level adjusters 821 and 822, on which processing for realizing the virtual speakers 701 and 702 is performed. Here, although a level does not basically change due to an input or out, the level may be changed using a coefficient K80 of the level adjuster 820 according to the subjective degree of effects of the realistic sensation.

In the same manner as above, the adder 832 outputs a signal to the SL speaker, and adds an output signal from each of the level adjusters 823 to 827, on which processing for realizing the virtual speakers 701 to 705 is performed.

In the same manner as above, the adder 833 outputs a signal to the SR speaker, and adds an output signal from each of the level adjusters 828 to 830, on which processing for realizing the virtual speakers 703 to 705 is performed. Other than the above described addition, in practice, the adder 832 adds signals processed for realizing the virtual speakers 708 to 710, and the adder 833 adds signals processed for realizing the virtual speakers 706 to 710.

The following explains an effect of a delay dependently connected to the equalizer. The virtual speakers 701 to 710 to be realizing are arranged in a rectangular shape as shown in FIG. 10. For that reason, the distance from a viewing point differs among the virtual speakers 701 to 710. In order to adjust the differences in the distance, an arrival time of a signal is adjusted to be the same, using the delay.

In addition, the delay is used to adjust a localization position when a signal for causing a precise sound image localization is input into the surround channel, in the same manner as Embodiment 1. When the position of the virtual speaker 703 is to be a localization position, for example, the virtual speaker 703 can be realized by increasing a delay amount of the delay characteristics Delay 86, 87, 89, and 90 by approximately 1 msec, with respect to the delay characteristics Delay 85 and 88 of the delay equalizers for realizing the virtual speaker 703.

As described above, the audio reproduction apparatus according to Embodiment 2 of the present invention controls the frequency characteristic and the level of an audio signal that is to be input such that the audio signal is added and distributed to the speakers that are placed, so that a diffuse sound field equivalent to a movie theatre or a movie sound production site is reproduced using the 5.1-channel speaker configuration having only a pair of the surround speakers, thereby reproducing content of movie content to a maximum.

It is to be noted that the multi-channel signals of the 5.1 channels are intended in Embodiment 2 according to the present invention; however, it is to be understood that multi-channel signals of 6.1 channels or 7.1 channels are treated as well by, for the multi-channel signals of the 7.1 channels, controlling using the virtual speakers 704, 705, 709, and 710 as speakers for the surround back channel reproduction.

In addition, although the sound source localization position of the surround channel is adjusted using a delay, it is to be understood that the present invention is also implemented by adjusting the level adjuster so as to increase the level of a reproduced sound from the surround speaker whose localization should be precise.

INDUSTRIAL APPLICABILITY

The audio reproduction apparatus according to the present invention allows feeling a natural surround which is seamless in all of the directions, without affected by the positional relationship between the speakers and a viewer, without losing a surround feeling of content, and without being aware of the fact that the sound is reproduced from the speakers, using the 5.1-channel speaker configuration. The full-scale sound field reproduction (a sound field reproduction equivalent to a movie theatre or a movie production site) with smaller number of speakers is particularly effective to expand a market of home theatres in which an easy operation and placement is desired.

REFERENCE SIGNS LIST

10 monitor
11 deck
12 center channel speaker
13 front L channel speaker
14 front R channel speaker
15 side L channel speaker
16 side R channel speaker
17 low frequency effect channel speaker
18 viewing space
101 signal generating unit
102 signal processing unit
103 power amplifier
104 to 109 speaker
201 to 206 virtual speaker
301 to 312 delay equalizer
313 to 328 level adjuster
329 to 332 adder
601 signal generating unit
602 signal processing unit
603 power amplifier
701 to 710 virtual speaker
801 to 810 delay equalizer
820 to 830 level adjuster
831 to 833 adder

The invention claimed is:

1. An audio reproduction apparatus which performs signal processing on an audio signal so that, when the audio signal is reproduced by a first speaker and a second speaker which actually exist, a viewer perceives the audio signal as being reproduced by a virtual speaker, the virtual speaker being assumed to be placed between the first speaker and the second speaker with respect to a predetermined viewing position, said audio reproduction apparatus comprising:

a first signal processing unit configured to equalize a first audio signal using a first equalizer characteristic that converts a characteristic of an audio signal perceived as being reproduced at a position of the first speaker with respect to the viewing position to be perceived as being reproduced at a position of the virtual speaker with respect to the viewing position;

a second signal processing unit configured to equalize the first audio signal using a second equalizer characteristic that converts a characteristic of an audio signal perceived as being reproduced at a position of the second speaker with respect to the viewing position to be perceived as being reproduced at the position of the virtual speaker with respect to the viewing position;

a first level adjuster which performs level adjustment, using a first coefficient, on an output signal of said first signal processing unit;

a second level adjuster which performs level adjustment, using a second coefficient, on an output signal of said second signal processing unit;

a first adder which adds, and outputs to the first speaker, an output signal of said first level adjuster and the first audio signal; and a second adder which adds, and outputs to the second speaker, an output signal of said second level adjuster and a second audio signal to be reproduced by the second speaker.

2. The audio reproduction apparatus according to claim 1, wherein the first equalizer characteristic is a transfer characteristic obtained by dividing a transfer characteristic from the position of the virtual speaker to the viewing position by a transfer characteristic from the first speaker to the viewing position, the second equalizer characteristic is a transfer characteristic obtained by dividing the transfer characteristic from the position of the virtual speaker to the viewing position by a transfer characteristic from the second speaker to the viewing position, said first signal processing unit is configured to delay, and output to said first level adjuster, the first audio signal using a first delay characteristic after equalizing the first audio signal using the first equalizer characteristic, and said second signal processing unit is configured to delay, and output to said second level adjuster, the first audio signal using a second delay characteristic after equalizing the first audio signal using the second equalizer characteristic.

3. The audio reproduction apparatus according to claim 2, wherein the first equalizer characteristic and the second equalizer characteristic are a frequency characteristic of an amplitude component of the first transfer characteristic and a frequency characteristic of an amplitude component of the second transfer characteristic, respectively.

4. The audio reproduction apparatus according to claim 3, wherein each of the first equalizer characteristic and the second equalizer characteristic is a characteristic obtained by extracting characteristic portions of a peak and a dip of the frequency characteristic of the amplitude component in a band of 1 kHz or higher.

5. The audio reproduction apparatus according to claim 1, wherein a period of delay time of each of the first delay characteristic and the second delay characteristic is equal to or shorter than a period of time during which the Haas effect is produced.

6. The audio reproduction apparatus according to claim 2, wherein, when K1 denotes the first coefficient, K2 denotes the second coefficient, θ1 denotes an angle between the first speaker and the virtual speaker with respect to the viewing position, and θ2 denotes an angle between the virtual speaker and the second speaker with respect to the viewing position, Expression 1

$$\frac{K1}{K2} = \frac{|\sin\theta 2|}{|\sin\theta 1|}$$

is satisfied.

7. The audio reproduction apparatus according to claim 2, further comprising:

a third signal processing unit configured to equalize the second audio signal using a third equalizer characteristic and delay the equalized second audio signal using a third delay characteristic;

a third level adjuster which performs level adjustment, using a third coefficient, on an output signal of said third signal processing unit;

a fourth signal processing unit configured to equalize the second audio signal using a fourth equalizer characteristic and delay the equalized second audio signal using a fourth delay characteristic; and a fourth level adjuster which performs level adjustment, using a fourth coefficient, on an output signal of said fourth signal processing unit, wherein said first adder further adds an output signal of said third level adjuster, said second adder further adds an output signal of said fourth level adjuster, the third equalizer characteristic, when the virtual speaker is a first virtual speaker and a second virtual speaker is a virtual speaker assumed to be placed between the first virtual speaker and the second speaker with respect to the viewing position, is a third transfer characteristic obtained by dividing a transfer characteristic from the second virtual speaker to the viewing position by a transfer characteristic from the first speaker to the viewing position, and the fourth equalizer characteristic is a fourth transfer characteristic obtained by dividing a transfer characteristic from the second virtual speaker to the viewing position by a transfer characteristic from the second speaker to the viewing position.

8. The audio reproduction apparatus according to claim 2, wherein the transfer characteristic is a head-related transfer characteristic.

9. The audio reproduction apparatus according to claim 2, wherein each of the first to fourth equalizer characteristics is calculated, as the transfer characteristic, by using a head-related transfer characteristic to an ear on a side where the first virtual speaker or the second virtual speaker is placed.

10. The audio reproduction apparatus according to claim 7, wherein, when K3 denotes the third coefficient, K4 denotes the fourth coefficient, θ3 denotes an angle between the first speaker and the second virtual speaker with respect to the viewing position, and θ4 denotes an angle between the second virtual speaker and the second speaker with respect to the viewing position, Expression 2

$$\frac{K3}{K4} = \frac{|\sin\theta 4|}{|\sin\theta 3|}$$

is satisfied.

11. The audio reproduction apparatus according to claim 7, wherein the first audio signal, the second audio signal, the first speaker, and the second speaker correspond to a front L channel signal, a surround L channel signal, a front L channel speaker, and a surround L channel speaker, respectively, and the first audio signal, the second audio signal, the first speaker, and the second speaker also correspond to a front R channel signal, a surround R channel signal, a front R channel speaker, and a surround R channel speaker, respectively.

12. The audio reproduction apparatus according to claim 11, wherein, when an angle of a direction toward a front of the viewing position is 0 degree, the first speaker and the second speaker are placed at 30 degrees and the 120 degrees, respectively, in a counterclockwise direction, or at 30 degrees and the 120 degrees, respectively, in a clockwise direction, and the first virtual speaker and the second virtual speaker are placed at 60 degrees and the 90 degrees, respectively, in the counterclockwise direction, or at 60 degrees and the 90 degrees, respectively, in the clockwise direction.

13. The audio reproduction apparatus according to claim 11, further comprising:

a fifth signal processing unit configured to perform signal processing on a third audio signal by equalizing the third audio signal using a fifth equalizer characteristic and delaying the equalized third audio signal using a fifth delay characteristic, and to cause the third audio signal on which the signal processing is performed to be reproduced by a third speaker, so that the third audio signal is localized at a position of a third virtual speaker assumed to be placed between the third speaker and a fourth speaker with respect to the viewing position;

a sixth signal processing unit configured to perform signal processing on the third audio signal by equalizing the third audio signal using a sixth equalizer characteristic and delaying the equalized third audio signal using a sixth delay characteristic, and to cause the third audio signal on which the signal processing is performed to be reproduced by the fourth speaker, so that the third audio signal is localized at a position of the third virtual speaker;

a seventh signal processing unit configured to perform signal processing on a fourth audio signal by equalizing the fourth audio signal using a seventh equalizer characteristic and delaying the equalized fourth audio signal using a seventh delay characteristic, and to cause the fourth audio signal on which the signal processing is performed to be reproduced by the third speaker, so that the fourth audio signal is localized at a position of a fourth virtual speaker assumed to be placed between the third virtual speaker and the fourth speaker with respect to the viewing position; and an eighth signal processing unit configured to perform signal processing on the fourth audio signal by equalizing the fourth audio signal using an eighth equalizer characteristic and delaying the equalized fourth audio signal using an eighth delay characteristic, and to cause the fourth audio signal on which the signal processing is performed to be reproduced by the fourth speaker, so that the fourth audio signal is localized at a position of the fourth virtual speaker, wherein the third speaker is the SL speaker, and the fourth speaker is the SR speaker, said second adder that outputs a signal to the SL speaker further adds an output signal of said fifth signal processing unit and an output signal of said seventh signal processing unit, and said second adder that outputs a signal to the SR speaker further adds an output signal of said sixth signal processing unit and an output signal of said eighth signal processing unit.

14. The audio reproduction apparatus according to claim 13, wherein said audio reproduction apparatus reproduces a multi-channel audio signal including: the front L channel signal (FL signal), the front R channel signal (FR signal), the surround L channel signal (SL signal), the surround R channel signal (SR signal), a surround back L channel signal (BL signal), and a surround back R channel signal (BR signal), the third audio signal is the BL signal and the fourth audio signal is the BR signal, the third virtual speaker is a virtual BL speaker which reproduces the BL signal at a position of 150 degrees in a counterclockwise direction when an angle of a direction toward a front of the viewing position is 0 degree, and the fourth virtual speaker is a virtual BR speaker which reproduces the BR signal at a position of 150 degrees in a clockwise direction when the angle of the direction toward the front of the viewing position is 0 degree, said fifth signal processing unit is configured to equalize the BL signal using the fifth equalizer characteristic obtained by dividing a transfer characteristic from a position of the virtual BL speaker to the viewing position by a transfer characteristic from a position of the SL speaker to the viewing position and delay the equalized BL signal using the fifth delay characteristic, said sixth signal processing unit is configured to equalize the BL signal using the sixth equalizer characteristic obtained by dividing the transfer characteristic from the position of the virtual BL speaker to the viewing position by a transfer characteristic from the position of the SR speaker to the viewing position and delay the equalized BL signal using the sixth delay characteristic, said seventh signal processing unit is configured to equalize the BR signal using the seventh equalizer characteristic obtained by dividing a transfer characteristic from a position of the virtual BR speaker to the viewing position by the transfer characteristic from the position of the SL speaker to the viewing position and delay the equalized BR signal using the seventh delay characteristic, and said eighth signal processing unit is configured to equalize the BR signal using the eighth equalizer characteristic obtained by dividing the transfer characteristic from the position of the virtual BR speaker to the viewing position by the transfer characteristic from the position of the SR speaker to the viewing position and delay the equalized BR signal using the eighth delay characteristic.

15. The audio reproduction apparatus according to claim 14, further comprising:

a fifth level adjuster which performs level adjustment, using a fifth coefficient, on an output signal of said fifth signal processing unit;

a sixth level adjuster which performs level adjustment, using a sixth coefficient, on an output signal of said sixth signal processing unit;

a seventh level adjuster which performs level adjustment, using a seventh coefficient, on an output signal of said seventh signal processing unit; and an eighth level adjuster which performs level adjustment, using an eighth coefficient, on an output signal of said eighth signal processing unit, wherein said second adder that outputs a signal to the SL speaker receives the output signal of said fifth signal processing unit and the output signal of the seventh signal processing unit via said fifth level adjuster and said seventh level adjuster, respectively, and adds the received signals to an other input signal, and said second adder that outputs a signal to the SR speaker receives the output signal of said sixth signal processing unit and the output signal of the eighth signal processing unit via said sixth level adjuster and said eighth level adjuster, respectively, and adds the received signals to an other input signal.

16. The audio reproduction apparatus according to claim 13, wherein said audio reproduction apparatus reproduces a multi-channel audio signal including: the front L channel signal (FL signal), the front R channel signal (FR signal), the surround L channel signal (SL signal), and the surround R channel signal (SR signal), the third audio signal is the SL signal and the fourth audio signal is the SR signal, said first signal processing unit is configured to equalize the FL signal and the FR signal using the first equalizer characteristic, to delay each of the equalized FL signal and FR signal using the first delay characteristic, and to cause the delayed FL signal and FR signal to be output to the FL speaker and the FR speaker, respectively, so that the FL signal is localized at a position of a virtual FL speaker and the FR signal is localized at a position of a virtual FR speaker, the virtual FL speaker being assumed to be placed on a left wall with respect to the viewing position and in a direction between the FL speaker and the SL speaker, and the virtual FR speaker being assumed to be placed on a right wall with respect to the viewing position and in a direction between the FR speaker and the SR speaker, said second signal processing unit is configured to equalize the FL signal and the FR signal using the second equalizer characteristic, to delay each of the equalized FL signal and FR signal using the second delay characteristic, and to cause the delayed FL signal and FR signal to be output to the SL speaker and the SR speaker, respectively, so that the FL signal is localized at the position of the virtual FL speaker and the FR signal is localized at the position of the virtual FR speaker, said third signal processing unit is configured to equalize the SL signal and the SR signal using the third equalizer characteristic, to delay each of the equalized SL signal and SR signal using the third delay characteristic, and to cause the delayed SL signal and SR signal to be output to the FL speaker and the FR speaker, respectively, so that the SL signal is localized at a position of a virtual SL speaker and the SR signal is localized at a position of a virtual SR speaker, the virtual SL speaker being assumed to be placed on a left wall with respect to the viewing position and in a direction between the virtual FL speaker and the SL speaker, and the virtual SR speaker being assumed to be placed on a right wall with respect to the viewing position and in a direction between the virtual FR speaker and the SR speaker, said fourth signal processing unit is configured to equalize the SL signal and the SR signal using the fourth equalizer characteristic, to delay each of the equalized SL signal and SR signal using the fourth delay characteristic, and to cause the delayed SL signal and SR signal to be output to the SL speaker and the SR speaker, respectively, so that the SL signal is localized at the position of the virtual SL speaker and the SR signal is localized at the position of the virtual SR speaker, said fifth signal processing unit is configured to equalize the SL signal using the fifth equalizer characteristic, to delay the equalized SL signal using the fifth delay characteristic, and to cause the delayed SL signal to be reproduced by the SL speaker, so that the SL signal is localized at a position of a second virtual SL speaker assumed to be placed on a back wall and in a direction between the SL speaker and the SR speaker with respect to the viewing position, said sixth signal processing unit is configured to equalize the SL signal using the sixth equalizer characteristic, to delay the equalized SL signal using the sixth delay characteristic, and to cause the delayed SL signal to be reproduced by the SR speaker, so that the SL signal is localized at a position of the second virtual SL speaker, said seventh signal processing unit is configured to equalize the SR signal using the seventh equalizer characteristic, to delay the equalized SR signal using the seventh delay characteristic, and to cause the delayed SR signal to be reproduced by the SL speaker, so that the SR signal is localized at a position of a second virtual SR speaker assumed to be placed on a back wall and in a direction between the second virtual SL speaker and the SR speaker with respect to the viewing position, and said eighth signal processing unit is configured to equalize the SR signal using the eighth equalizer characteristic, to delay the equalized SR signal using the eighth delay characteristic, and to cause the delayed SR signal to be reproduced by the SR speaker, so that the SR signal is localized at a position of the second virtual SR speaker.

17. The audio reproduction apparatus according to claim 16, wherein said first signal processing unit and said second signal processing unit are a plurality of said first signal processing units and a plurality of said second signal processing units, respectively, each of said first signal processing units and said second signal processing units having the equalizer characteristics different from each other and the delay characteristics different from each other, for causing a plurality of the virtual FL speakers to be localized in different positions on a wall positioned on the left with respect to the viewing position and concurrently causing a plurality of the virtual FR speakers to be localized in different positions on a wall positioned on the right with respect to the viewing position, said third signal processing unit and said fourth signal processing unit are a plurality of said third signal processing units and a plurality of said fourth signal processing units, respectively, each of said third signal processing units and said fourth signal processing units having the equalizer characteristics different from each other and the delay characteristics different from each other, for causing a plurality of the virtual SL speakers to be localized in different positions on the wall positioned on the left with respect to the viewing position and concurrently causing a plurality of the virtual SR speakers to be localized in different positions on the wall positioned on the right with respect to the viewing position, and said fifth signal processing unit, said sixth signal processing unit, said seventh signal processing unit, and said eighth signal processing unit are a plurality of said fifth signal processing units, a plurality of said sixth signal processing units, a plurality of said seventh signal processing units, and a plurality of said eighth signal processing units, each of said sixth signal processing units, said seventh signal processing units, and said eighth signal processing units having the equalizer characteristics different from each other and the delay characteristics different from each other, for causing a plurality of the second virtual SL speakers to be localized in different positions on a wall positioned behind the viewing position and concurrently causing a plurality of the virtual SR speakers to be localized in different positions on the wall.

18. An integrated circuit comprising said first signal processing unit, said second signal processing unit, said first level adjuster, said second level adjuster, the first speaker, and the second speaker, according to claim 1.

19. An audio reproduction method of performing signal processing on an audio signal so that, when the audio signal is reproduced by a first speaker and a second speaker which actually exist, a viewer perceives the audio signal as being reproduced by a virtual speaker, the virtual speaker being assumed to be placed between the first speaker and the second speaker with respect to a predetermined viewing position, said audio reproduction method comprising:

a first signal processing step of equalizing a first audio signal using a first equalizer characteristic that converts a characteristic of an audio signal perceived as being reproduced at a position of the first speaker with respect to the viewing position to be perceived as being reproduced at a position of the virtual speaker with respect to the viewing position;

a second signal processing step of equalizing the first audio signal using a second equalizer characteristic that converts a characteristic of an audio signal perceived as being reproduced at a position of the second speaker with respect to the viewing position to be perceived as being reproduced at the position of the virtual speaker with respect to the viewing position;

a first amplification step of performing level adjustment, using a first coefficient, on an output signal of said first signal processing step;

a second amplification step of performing level adjustment, using a second coefficient, on an output signal of said second signal processing step;

a first adding step of adding, and outputting to the first speaker, an output signal of said first amplification step and the first audio signal; and a second adding step of adding, and outputting to the second speaker, an output signal of said second amplification step and a second audio signal to be reproduced by the second speaker.

* * * * *